US005899833A

United States Patent [19]

Ryan et al.

[11] Patent Number: 5,899,833

[45] Date of Patent: May 4, 1999

[54] ORBITAL STEPPING EXERCISE APPARATUS

[75] Inventors: Allen L. Ryan, Chicago; Steven M. Lenz, Naperville; Clifford F. Mueller, Palatine; Gary E. Oglesby, Manhattan; Charles J. Rosenow, Carol Stream, all of Ill.

[73] Assignee: Brunswick Corporation, Lake Forest, Ill.

[21] Appl. No.: 08/664,854

[22] Filed: Jun. 17, 1996

[51] Int. Cl.[6] ..... A63B 22/04; A63B 24/00

[52] U.S. Cl. ..... 482/52; 482/5; 482/4

[58] Field of Search ..... 482/51–53, 70–73, 482/57, 1, 3–7, 901, 902, 6, 5, 8

[56] References Cited

U.S. PATENT DOCUMENTS

| | | | |
|---|---|---|---|
| 219,439 | 9/1879 | Blend . | |
| 3,316,898 | 5/1967 | Brown . | |
| 3,432,164 | 3/1969 | Deeks . | |
| 4,645,200 | 2/1987 | Hix . | |
| 4,679,786 | 7/1987 | Rodgers . | |
| 4,720,093 | 1/1988 | Del Mar . | |
| 4,779,863 | 10/1988 | Yang . | |
| 4,786,050 | 11/1988 | Geschwender . | |
| 4,850,585 | 7/1989 | Dalebout | 482/51 |
| 4,869,494 | 9/1989 | Lambert, Sr. . | |
| 4,880,225 | 11/1989 | Lucas et al. . | |
| 4,949,993 | 8/1990 | Stark et al. . | |
| 5,039,088 | 8/1991 | Shifferaw . | |
| 5,149,084 | 9/1992 | Dalebout et al. | 482/3 |
| 5,192,257 | 3/1993 | Panasewicz | 482/70 |
| 5,230,673 | 7/1993 | Maeyama et al. | 482/57 X |
| 5,242,343 | 9/1993 | Miller . | |
| 5,256,117 | 10/1993 | Potts et al. | 482/52 |
| 5,279,529 | 1/1994 | Eschenbach . | |
| 5,352,169 | 10/1994 | Eschenbach . | |
| 5,374,227 | 12/1994 | Webb | 4822/52 |
| 5,383,829 | 1/1995 | Miller . | |
| 5,466,200 | 11/1995 | Ulrich et al. | 486/6 X |
| 5,518,473 | 5/1996 | Miller | 482/51 X |
| 5,540,637 | 7/1996 | Rodgers, Jr. | 482/70 X |
| 5,549,526 | 8/1996 | Rodgers, Jr. | 482/70 X |
| 5,573,480 | 11/1996 | Rodgers, Jr. | 482/70 X |
| 5,577,985 | 11/1996 | Miller | 482/51 X |
| 5,593,372 | 1/1997 | Rodgers, Jr. | 482/51 X |
| 5,766,113 | 6/1998 | Rodgers, Jr. | 482/70 |

FOREIGN PATENT DOCUMENTS 29 19 494 11/1980 Germany .

*Primary Examiner*—Richard J. Apley
*Assistant Examiner*—Denise Pothier
*Attorney, Agent, or Firm*—Michael B. McMurry; Kathrine A. Ryan

[57] ABSTRACT

An exercise apparatus includes a frame, a pivot axis supported by the frame, a pedal lever, a coupler for pivotally coupling a first end of the pedal lever to the pivot axis at a predetermined distance from the pivot axis such that the first end moves in an arcuate pathway around the pivot axis, a guide member supported by the frame and engaging a second end of the pedal lever such that the second end of the pedal lever moves in a reciprocating pathway as the first end of the pedal lever moves in the arcuate pathway, and a pedal having a toe portion and a heel portion, the pedal being pivotally coupled with the second end of the pedal lever such that the toe portion is intermediate the heel portion and the pivot axis and the heel portion is raised above the toe portion when the second end moves in the reciprocating pathway in a direction away from the pivot axis. An exercise apparatus includes a frame, a pivot axis supported by the frame, a pedal lever, a coupler for pivotally coupling a first end of the pedal lever to the pivot axis at a predetermined distance from the pivot axis such that the first end moves in an arcuate pathway around the pivot axis, a guide member supported by the frame and engaging a second end of the pedal lever such that the second end of the pedal lever moves in a substantially level reciprocating pathway as the first end of the pedal lever moves in the arcuate pathway, a pedal spaced apart from the pedal lever, and a linkage member that links the pedal to the pedal lever such that the pedal travels in a substantially elliptical pathway as the first end of the pedal lever moves in the arcuate pathway.

120 Claims, 11 Drawing Sheets

ORBITAL STEPPING EXERCISE APPARATUS

FIELD OF THE INVENTION

This invention relates generally to exercise equipment and more particularly to exercise equipment which can be used to exercise the upper body and the lower body of the user.

BACKGROUND OF THE INVENTION

Exercise apparatuses are known that exercise a user's lower body by providing a circuitous stepping motion. These orbital stepping apparatuses provide advantages over other types of exercise apparatuses. For example, the orbital stepping motion generally does not jar the user's joints as can occur when a treadmill is used. In addition, orbital stepping apparatuses exercise the user's lower body to a greater extent than, for example, cycling-type exercise apparatuses or skiing-type exercise apparatuses. Examples of orbital stepping apparatuses include U.S. Pat. Nos. 3,316,898, 5,242,343, and 5,279,529 and German Patent No. DE 2,919,494.

However, known orbital stepping exercise apparatuses suffer from various drawbacks. For example, some apparatuses are limited to exercising the user's lower body and do not provide exercise for the user's upper body. In addition, the orbital stepping motion of some apparatuses produces an un-natural heel to toe flexure that reduces exercise efficiency. Moreover, known orbital stepping exercise apparatuses are limited in the extent to which the user can achieve a variety of exercise experiences. Consequently, boredom ensues and the user may lose interest in using the orbital stepping exercise apparatuses. A need therefore exists for an improved orbital stepping exercise apparatus.

SUMMARY OF THE INVENTION

It is therefore an object of the invention to provide an orbital stepping exercise apparatus that exercises the user's lower and upper body.

Another object of the invention is to provide an orbital stepping exercise apparatus that simulates a natural heel to toe flexure and thereby promotes exercise efficiency.

Another object of the invention is to provide an orbital stepping exercise apparatus that can be used in a multiplicity of modes by an individual user.

Another object of the invention is to provide an orbital stepping apparatus that can be tailored to the individual needs and desires of different users.

These and other objectives and advantages are provided by the present invention which is directed to an exercise apparatus that can be employed by a user to exercise the user's upper and lower body. The exercise apparatus includes a frame, a pivot axis that is supported by the frame, and a coupler that pivotally couples a first end of the pedal lever to the pivot axis at a predetermined distance from the pivot axis such that the first end moves in an arcuate pathway around the pivot axis. The exercise apparatus also includes a guide member that is supported by the frame and that engages a second end of the pedal lever such that the second end of the pedal lever moves in a reciprocating pathway as the first end of the pedal lever moves in the arcuate pathway. In addition, the exercise apparatus includes a pedal that has a toe portion and a heel portion and that is pivotally coupled with the second end of the pedal lever so that the toe portion is intermediate the heel portion and the pivot axis, and so that the heel portion is raised above the toe portion when the second end moves in the reciprocating pathway in a direction away from the pivot axis.

The guide member can include a first longitudinal track that is secured to the frame and is configured to support the second end of the pedal lever. A first roller is secured to the pedal lever and rests on the first longitudinal track. The guide member can further include a second longitudinal track that aligned with the first longitudinal track so that the first roller is engaged by the first and second longitudinal tracks. The first longitudinal track can have a substantially arcuate cross section which helps to minimize the amount of debris that accumulates on the track, in which case, the first roller preferably is concave. The exercise apparatus can further include a second roller that is affixed to the pedal lever and aligned with the first roller so that the second roller is engaged by the first and second longitudinal tracks. The reciprocating movement of the second end of the pedal lever tends to pull up on the second roller which consequently tends to ride primarily on the upper longitudinal track. The second roller thus provides vertical stability for the second end of the pedal lever. This two roller system therefore provides greater stability than can be achieved with a single roller system.

Alternatively, the second longitudinal track of the guide member can be laterally spaced apart from the first longitudinal track. In this case, the second roller is secured to the pedal lever such that the second roller engages the second longitudinal track. The guide member can further include a third track that is aligned with and positioned above the first longitudinal track and a fourth track that is aligned with and positioned above the second longitudinal track. The exercise apparatus can further include third roller and fourth rollers that are affixed to the pedal lever so that the third roller is engaged by the first and third tracks and so that the fourth roller is engaged by the second and fourth tracks. The first and second longitudinal tracks can have substantially arcuate cross sections, in which case the first and second rollers preferably are concave. Because the first and second rollers are laterally spaced apart, the first and second rollers provide lateral stability to the second end of the pedal lever. Moreover, as with the previously described embodiment, the reciprocating movement of the second end of the pedal lever tends to pull up on the third and fourth rollers which consequently tend to ride on the upper tracks. Consequently, this four roller system provides greater stability than can be achieved with a single roller system.

The exercise apparatus can include first and second cross members to which a first longitudinal track of the guide member is secured such that the first longitudinal track supports the second end of the pedal lever. A first roller is rotatably coupled with the second end of the pedal lever and rests on the first longitudinal track. The guide member can further include a second longitudinal track that is positioned above the first longitudinal track. A second roller that is rotatably coupled with the second end of the pedal lever rests on the second longitudinal track. The second longitudinal track preferably has a substantially arcuate cross section when tends to reduce the accumulation of dirt and debris. In addition, the second roller preferably is concave. The guide member can further include a third longitudinal track that is positioned above the first longitudinal track and has a substantially arcuate cross section. A third roller is rotatably coupled with the second end of the pedal lever so that the third roller is laterally spaced apart from the second roller. The third roller rests on the third longitudinal track and preferably is concave. The exercise apparatus can also include a fourth roller that is rotatably coupled with the second end of the pedal lever and is laterally spaced apart from the first roller. The fourth roller rests on the first longitudinal track.

The present invention is also directed to an exercise apparatus than includes a frame, a pivot axis that is supported by the frame, a pedal lever, and a coupler that pivotally couples a first end of the pedal lever to the pivot axis at a predetermined distance from the pivot axis such that the first end moves in an arcuate pathway around the pivot axis. The exercise apparatus also includes a guide member that is supported by the frame and engages a second end of the pedal lever such that the second end of the pedal lever moves in a substantially level reciprocating pathway as the first end of said pedal lever moves in the arcuate pathway. In addition, the exercise apparatus includes a pedal that is spaced apart from the pedal lever and linkage means that link the pedal to the pedal lever such that the pedal travels in a substantially elliptical pathway as the first end of the pedal lever moves in the arcuate pathway.

The pedal includes a vertical member that is pivotally connected to the pedal lever at a first pivot point. The linkage means includes a pedal link and slider means. The pedal link is pivotally coupled to the vertical member at a second pivot point and is pivotally coupled to the pedal lever at a third pivot point to define a first link having a predetermined length between the second and third pivot points. The slider means is affixed to the pedal lever at a predetermined slider point to define a second link having a predetermined length between the first pivot point and the slider point.

The exercise apparatus can further include a first longitudinal track that is secured to the frame and is configured to support the slider means. The slider means can include a first roller that is rotatably coupled to the pedal lever and rests on the first longitudinal track. The guide member can further include a second longitudinal track that is aligned with and positioned above the first longitudinal track so that the first and second longitudinal tracks engage the first roller. The first longitudinal track can have a substantially arcuate cross section, in which case the first roller preferably is concave.

The slider means can further include a second roller that is aligned with the first roller and is engaged by the first and second tracks. Alternatively, the second roller can be rotatably coupled to the pedal lever substantially opposite the first roller, in which case the second longitudinal track is laterally spaced apart from the first longitudinal track and is configured to engage the second roller. The guide member can further include third and fourth tracks, the third track being aligned with and positioned above the first longitudinal track, and the fourth track being aligned with and positioned above the second longitudinal track. The slider means can also include third and fourth rollers. The third roller is engaged by the first and third tracks and the fourth roller is engaged by the second and fourth tracks.

The exercise apparatus can include first and second cross members to which a first longitudinal track of the guide member is secured. The first longitudinal track is configured to support the second end of the pedal lever. The slider means includes a first roller that is rotatably coupled with the pedal lever and rests on the first longitudinal track. The guide member can further include a second longitudinal track and the slider means can further include a second roller. The second longitudinal track is positioned above the first longitudinal track and the second roller is rotatably coupled with the pedal lever so that the second roller rests on the second longitudinal track. The second longitudinal track can have a substantially arcuate cross section, in which case the second roller preferably is concave. The guide member can further include a third longitudinal track and the slider means can further include a third roller. The third longitudinal track is positioned above the first longitudinal track and has a substantially arcuate cross section. The third roller, which is concave, is rotatably coupled with the pedal lever so that the third roller is laterally spaced apart from the second roller and rests on the third longitudinal track. The slider means can also include a forth roller that is rotatably coupled with the pedal lever so that the fourth roller is laterally spaced apart from the first roller and rests on the first longitudinal track.

The exercise apparatus can also include an arm and coupling means that couples the arm to the pedal lever such that the arm moves toward the second end of the pedal lever when the second end of the pedal lever moves in the reciprocating pathway in a direction towards the pivot axis. The arm permits the user to exercise the user's upper body while the user is also exercising the user's lower body. The exercise apparatus can also include a hand rail that is rigidly secured to the frame. Consequently, the user can use the exercise apparatus to exercise only the user's lower body.

The exercise apparatus can also include a vertical support member that is positioned intermediate the pivot axis and the second end of the pedal lever. The exercise apparatus can also include a first arm link that is pivotally coupled with the pedal lever proximate to the second end and extends toward the pivot axis, a second arm link that is pivotally coupled to the first arm link and extends from the first arm link toward the vertical support member, an arm, and a shaft that is rigidly secured to the second arm link. The shaft is rotatably supported by the vertical support member and is also rigidly secured to the arm so that the arm moves toward the second end of the pedal lever when the second end of the pedal lever moves in the reciprocating pathway in a direction towards the pivot axis. The arm permits the user to exercise the user's upper body while the user is also exercising the user's lower body. The exercise apparatus can also include a hand rail that is rigidly secured to the vertical support member. Consequently, the user can use the exercise apparatus to exercise only the user's lower body.

The exercise apparatus can further include resistance means that are secured to the frame and that apply a resistance force to the pedal, and transmission means which are operatively connected to the resistance means and to the pivot axis and which transmit the resistance force to the pedal. The resistance means can include an alternator. In addition, the exercise apparatus can include a microprocessor that is operatively connected to the resistance means and that controls the amount of resistive force that the resistance means provides. The exercise apparatus can therefore provide different levels of pedal resistance that can be tailored to the individual needs and desires of different users. In addition, the microprocessor can be pre-programmed to provide different exercise routines that can be chosen by the user when the user is exercising on the exercise apparatus.

An exercise apparatus in accordance with the present invention can be used by a user to simulate both a forward stepping motion and a backward stepping motion. When the user manipulates the pedal in the forward stepping motion, the heel portion of the pedal is raised above the toe portion when the second end of the pedal lever moves in the reciprocating pathway in a direction away from the pivot axis. The user's weight is thus shifted to the toe portion as it would be if the user were completing a non-assisted forward step. When the user manipulates the pedal in the backward stepping motion, the heel portion of the pedal is lowered below the toe portion when the second end of the pedal lever moves in the reciprocating pathway in a direction away from the pivot axis. The user's weight is thus shifted to the heel portion as it would be if the user were completing a non-assisted backward step. The pivotal coupling of the pedal to the pedal lever thus simulates a natural heel to toe flexure when the exercise apparatus is used to produce either a forward stepping motion or a backward stepping motion. Consequently, an exercise apparatus in accordance with the present invention reduces or eliminates stresses that can occur from un-natural flexures and thus promotes exercise efficiency and promotes an enjoyable exercise experience. In addition, if the arm is used, an exercise apparatus in accordance with the present invention promotes exercise of the user's total body. Moreover, the movement of the arm generally opposes that of the second end of the pedal lever, resulting in an exercise gait that simulates a natural stepping gait. However, the fixed handrail can be used if the user desires only to exercise the user's lower body. An exercise apparatus in accordance with the present invention thus can be used by an individual user in a multiplicity of usage modes, thereby also enhancing exercise efficiency and promoting a pleasurable exercise experience. The microprocessor and the resistance means can provide different levels of pedal resistance that can be tailored to the individual needs and desires of different users. Last, an exercise apparatus in accordance with the present invention provides a wide variety of exercise programs that can be tailored to the specific needs and desires of different individual users, and consequently enhances exercise efficiency and promotes a pleasurable exercise experience.

BRIEF DESCRIPTION OF THE DRAWINGS

FIG. 13 is a graph of the percentage of time that the field control signal is enabled vs. the RPM signal when the exercise apparatus in FIG. 1 is used with the pace mode on.

DETAILED DESCRIPTION

Figure 1:
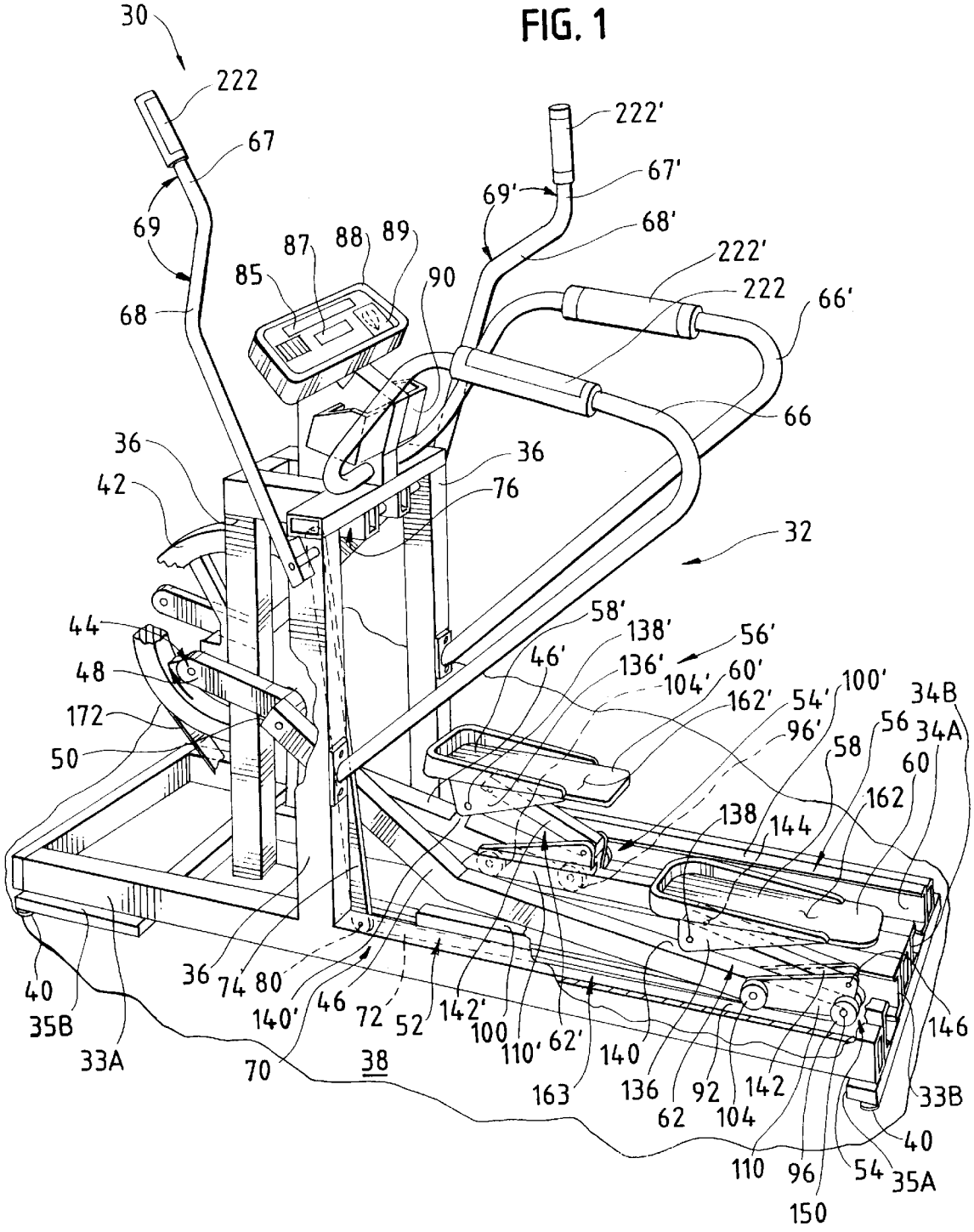
FIG. 1 is partially cut-away side perspective view of an exercise apparatus according to the invention.
Figure 2:
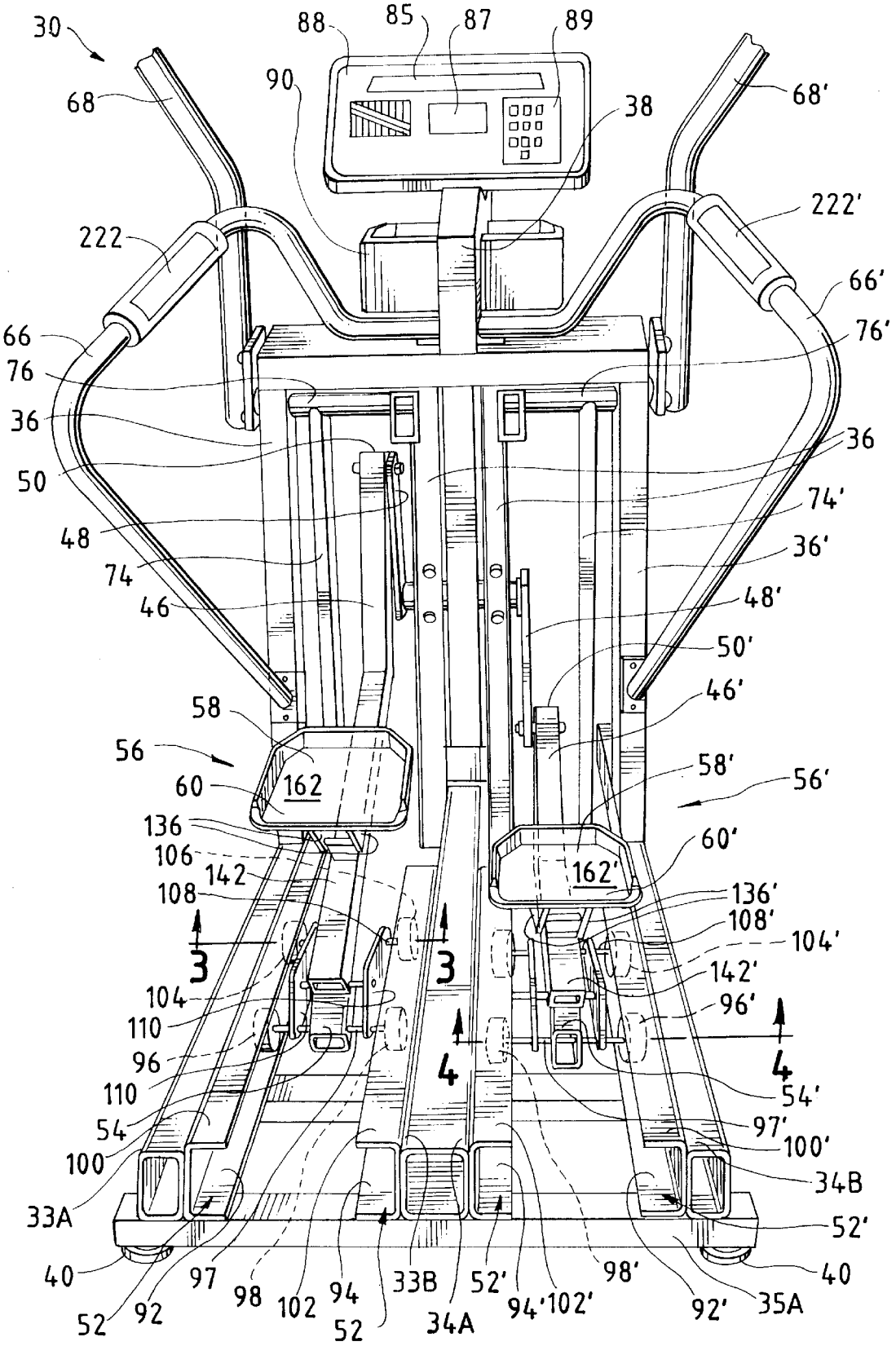
FIG. 2 is a partial rear perspective view of the exercise apparatus in FIG. 1.

FIGS. 1 and 2 provide side and rear perspective views, respectively, of an exercise apparatus 30 according to the invention. The apparatus 30 includes a frame, shown generally at 32, which includes vertical support member 36 and longitudinal support members 33A, 33B, 34A, 34B that are secured to cross member 35A and 35B. The cross members 35A and 35B are configured for placement on a floor 38. Levelers 40 are provided so than if the floor 38 is uneven, the cross members 35A and 35B can be raised or lowered such that the cross members 35A and 35B and the longitudinal support members 33A, 33B, 34A, 34B are substantially level. The apparatus further includes a pulley 42 supported by the frame 32 around a pivot axis 44. In the preferred embodiment the pulley 42 is supported by pillow block bearings (not shown) which are attached to and extend from the vertical support members 36 to the pivot axis 44.

The pedalling mechanism of the apparatus 30 is symmetrical and includes a left portion and a right portion. The following description is directed to the components of the left portion, although it is to be understood that the right portion includes like components that operate in a like fashion. In the Figures, the components of the right portion are referenced with prime numbers that correspond to the reference numbers used for the components of the right portion. The pedalling mechanism of the apparatus 30 includes a pedal lever 46 that is coupled to the pivot axis 44 by a coupler 48 that maintains a first end 50 of the pedal lever 46 at a predetermined distance from the pivot axis 44 so that the first end 50 moves in an arcuate pathway around the pivot axis 44 when the pulley 42 rotates. In the preferred embodiment, coupler 48 is a bell crank. The frame 32 supports a guide member, shown generally at 52, that engages a second end 54 of the pedal lever 46 so that the second end 54 moves in a reciprocating pathway as the first end 50 moves in the arcuate pathway around the pivot axis 44.

The exercise apparatus 30 further includes a pedal 56 that includes a toe portion 58 and a heel portion 60 and a linkage assembly 62 that links the pedal 56 to the pedal lever 46 so that the toe portion 58 is intermediate the heel portion 60 and the pivot axis 44. As is explained in more detail below in reference to FIGS. 7 and 8, the linkage assembly 62 links the pedal 56 to the pedal lever 46 such that the pedal 56 travels in a substantially elliptical pathway 64 (shown in FIG. 10) as the first end 50 of the pedal lever 46 travels in the arcuate pathway around the pivot axis 44. In the preferred embodiment, the first end 50 can move in two arcuate pathways around the pivot axis. First, the first end 50 can move in a counterclockwise arcuate pathway, as seen from the user's left side. When the first end 50 travels in the counterclockwise arcuate pathway, the pedal 56 travels in a direction along the elliptical pathway 64 that simulates a forward stepping motion. In the forward stepping mode, as the pedal 56 moves in the elliptical pathway 64, the heel portion 60 is lowered below the toe portion 58 when the second end 54 of the pedal lever moves in the reciprocating pathway in a direction towards the pivot axis 44. Second, the first end 50 can move in a clockwise arcuate pathway, as seen from the user's left side. When the first end 50 travels in the clockwise arcuate pathway, the pedal 56 travels in a direction along the elliptical pathway 64 that simulates a backward stepping motion. In the backward stepping mode, as the pedal 56 moves in the elliptical pathway 64, the heel portion 60 is initially raised with respect the toe portion 58 when the second end 54 of the pedal lever moves in the reciprocating pathway in a direction towards the pivot axis 44 (shown in 9A, 9F and 9E).

In the preferred embodiment, the exercise apparatus also includes a hand rail 66 and an arm 68. The handrail 66 is rigidly secured to the frame 32. In contrast, the arm 68 is coupled to the pedal lever 46 by a coupling assembly, shown generally at 70, so that the arm 68 moves toward the second end 54 of the pedal lever 46 when the second end 54 of the pedal lever 46 moves in the reciprocating pathway towards the pivot axis 44. Specifically, coupling assembly 70 includes a first arm link 72, a second arm link 74 and a shaft 76. The first arm link 72 is coupled with the pedal lever 46 at a pivot point 78 (shown in FIG. 3) located near the second end 54 of the pedal lever 46. The second arm link 74 is coupled with the first arm link 72 at a second pivot point 80 and is rigidly secured to the shaft 76. The shaft 76 is rotatably supported by the vertical support members 36 and is in turn rigidly secured to the arm 68. As a result, when the second end 54 of the pedal lever 46 moves towards the pivot axis 44, the first arm link 72 also moves toward the pivot axis 44 causing the second pivot point 80 to move toward the pivot axis 44. In turn, this causes the shaft 76 to rotate in a clock-wise direction as seen in FIG. 1, so that the arm 68 moves rearward towards the second end 54 of the pedal lever 46. In the reverse direction, as the second end 54 of the pedal lever 54 moves away from the pivot axis 44, the first arm link 72 and the second arm link 74 act on the shaft 76 so that the shaft 74 rotates in a generally counter-clockwise direction as seen in FIG. 1. Consequently, the arm 68 moves towards the pivot axis 44 and away from the second end 54 of the pedal lever 46. In the preferred embodiment, a hand grip 67 is rigidly secured to the arm 68 at a predetermined angle 69 which is chosen to promote ergonomic efficiency.

The exercise apparatus 30 also includes an alternator 82 (shown in FIG. 7) and a transmission 84 (shown in FIGS. 7 and 8) that includes the pulley 42. As is explained in more detail in reference to FIGS. 9–14, the alternator 82 provides a resistive force that is transmitted to the pedal 56 and to the arm 68 through the transmission 84. The alternator 82 thus acts as a brake to limit the movement of the pedal 56 and of the arm 68. Alternatively, a resistive force can be provided by any suitable component, for example, by an eddy current brake, a friction brake, a band brake, or a hydraulic braking system. In the preferred embodiment, the exercise apparatus 30 includes a microprocessor 86 (shown in FIG. 11) housed within a console 88. The console 88 includes a message center 85, a display panel 87 to display information to the user and a data input center 89 which accepts data from the user. The microprocessor 86 is operatively coupled to both the data input center 89 and the resistance component, such as the alternator 82, and in the preferred embodiment the microprocessor 86 is a Motorola HC-11. Data provided by the user thus can be used to change the resistive force provided by the resistive component 82 through the interaction of the microprocessor 86 and the resistive component 82. The microprocessor 86, the message center 85, the display panel 87, and the data input center 89 are discussed in more detail with reference to FIGS. 11 and 12. The exercise apparatus 30 can also include an accessory tray 90 for storing various items, such as a water bottle.

Figure 3:
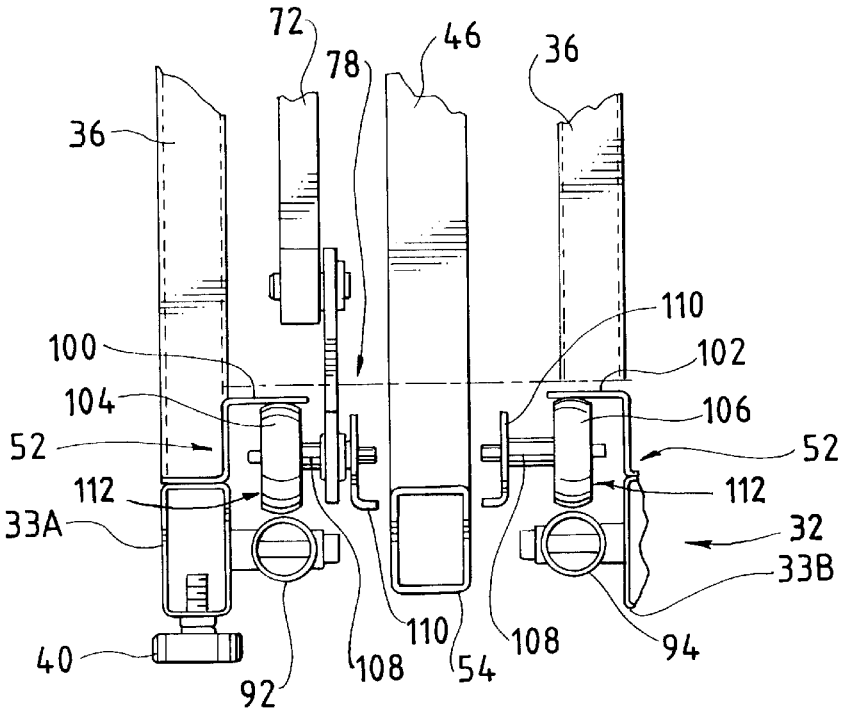
FIG. 3 is a partial cross section along line 3—3 in FIG. 2.
Figure 4:
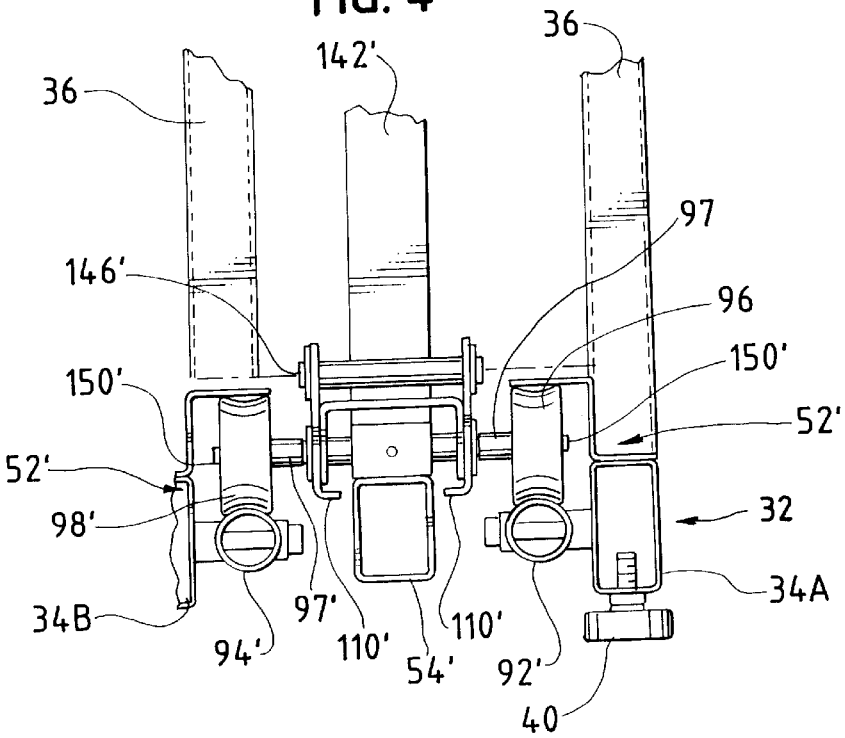
FIG. 4 is a partial cross section along line 4—4 in FIG. 2.

FIGS. 3 and 4 show one embodiment of the guide member 52 which includes longitudinal tracks 92 and 94 that are secured to the frame 32 and are configured to support the second end 54 of the pedal lever 46. The longitudinal tracks 92 and 94 preferably are secured to the longitudinal support members 33A, 33B. Consequently, the longitudinal tracks 92 and 94 are substantially level. Rollers 96 and 98 rest on the longitudinal tracks 92 and 94 and are secured to the pedal lever 46 by an axle 97 that passes through the pedal lever 46. Upper longitudinal tracks 100 and 102 are secured to the frame 32 above the lower longitudinal tracks 92 and 94 and are aligned with the lower longitudinal tracks 92 and 94. Consequently, each vertical pair of longitudinal tracks, for example 92 and 100 or 94 and 102, engages one of the rollers 96 and 98. This dual track system provides greater lateral stability to the pedal 56 than would a single track system. A second set of rollers 104 and 106 is generally aligned with and located in front of the first set of rollers 96 and 98. The rollers 104 and 106 are supported on axles 108 that are carried by pedal carriages 110. The pedal carriages 110 are also pivotally secured to the axle 97. The rollers 94 and 96 and the pedal carriages 110, along with the rollers 104 and 106, together form a slider assembly 112 that cooperates with the longitudinal tracks 92, 94, 100, and 102 to direct the second end 54 of the pedal lever 46 in its generally level reciprocating pathway.

When the pedal lever 46 moves in its reciprocating pathway, the load carried by the first set of rollers 94 and 96 differs from that carried by the second set of rollers 104 and 106. Specifically, the first set of rollers 94 and 96 tend to carry a downwardly directed load and so travel primarily on the lower longitudinal tracks 92 and 94. In contrast, the reciprocating movement of the second end 54 of the pedal lever 46 tends to pull up on the second set of rollers 104 and 106 which consequently tend to ride primarily on the upper longitudinal tracks 100 and 102. In the preferred embodiment, the tracks 92 and 94 and the rollers 96, 98, 104, and 106 are configured to exploit the different load requirements. Specifically, the lower longitudinal tracks 92 and 94 are tubular and the first set of rollers 96 and 98 are concave. The arcuate cross-section of the lower longitudinal tracks 92 and 94 help to prevent accumulations of dirt and debris that could lead to excessive wear. The concave configuration of the rollers 96 and 98 in turn promotes lateral stability of the pedal lever 46 on the longitudinal tracks. The rollers 104 and 106, which ride primarily on the upper longitudinal tracks 100 and 102, preferably are convex.

Figure 5:
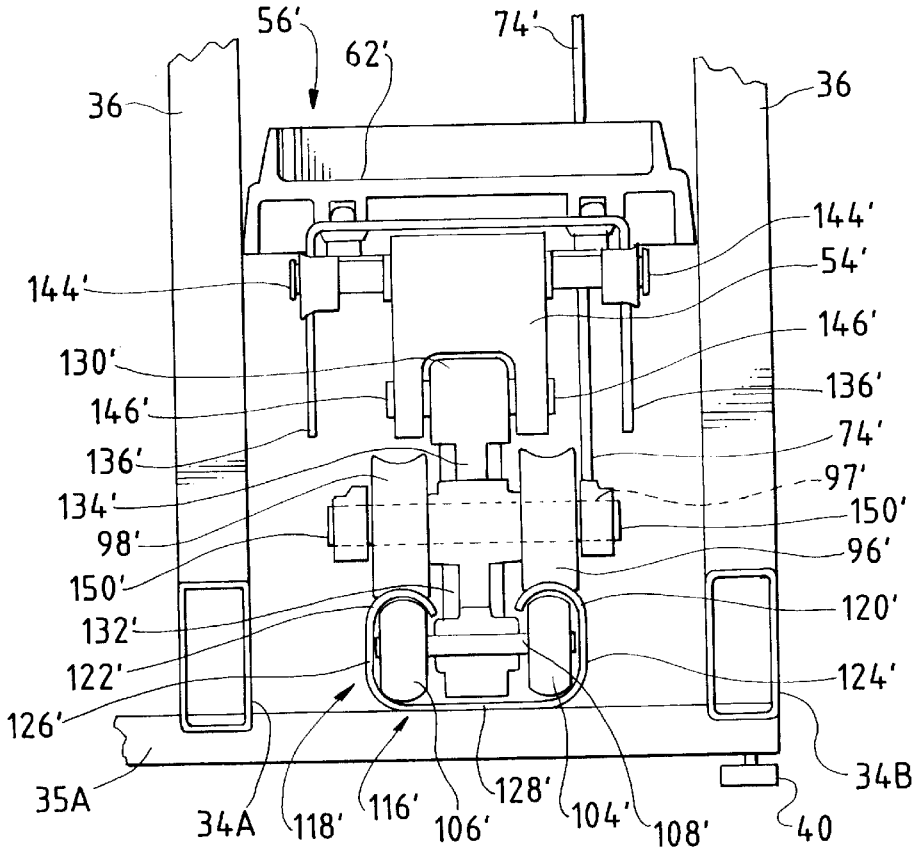
FIG. 5 is the same view as FIG. 4 and shows the preferred embodiment of the guide member and the slider assembly which are parts of the exercise apparatus of FIG. 1.
Figure 6:
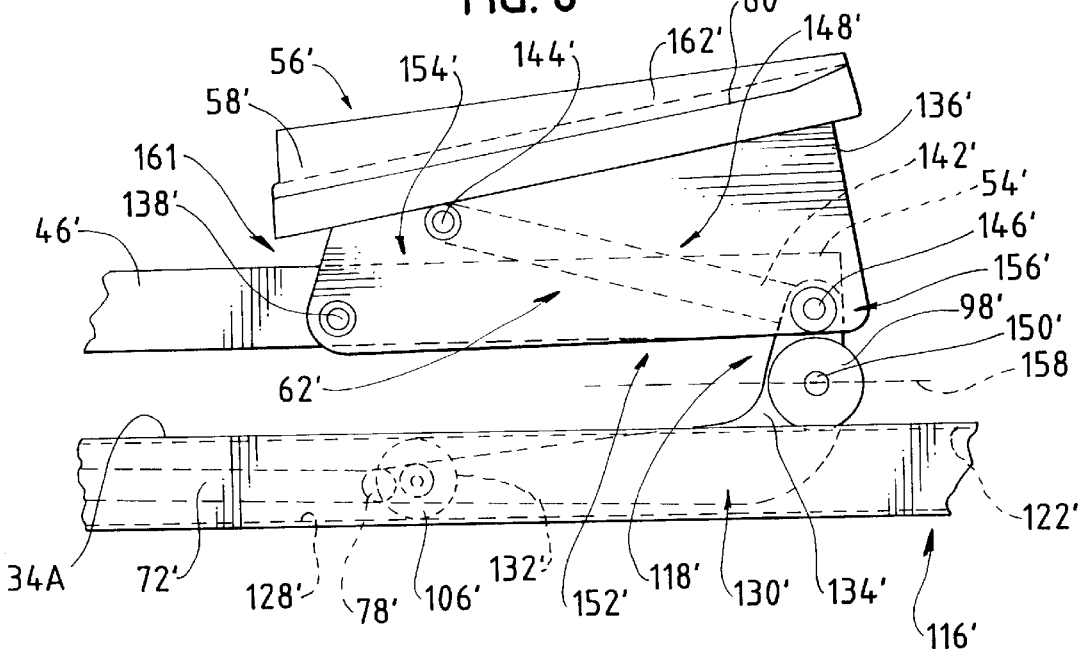
FIG. 6 is a stylized partial side view of the pedal, guide member, and slider assembly shown in FIG. 5.

FIGS. 5 and 6 show the preferred embodiment of a guide member 116 and the preferred embodiment of a slider assembly 118. The guide member 116 includes arcuate longitudinal tracks 120 and 122 that are secured by side members 124 and 126 to a lower longitudinal track 128. The lower longitudinal track 128 is secured to the cross members 35A and 35B (not shown). Consequently, the upper longitudinal tracks 120 and 122 and the lower longitudinal track 128 are substantially level. The concave rollers 96 and 98 of the slider assembly 118 are positioned on the arcuate longitudinal tracks 120 and 122. The convex roller 104 of the slider assembly 118 is positioned between the arcuate longitudinal track 120 and the lower longitudinal track 128 and the convex roller 106 of the slider assembly 118 is positioned between the arcuate longitudinal track 122 and the lower longitudinal track 128. The slider assembly 118 also includes a pedal carriage 130 that has a lower member 132 to which the convex rollers 104 and 106 are rotatably secured via the axle 108, as best seen in FIG. 6. The concave rollers 96 and 98 are rotatably secured via the axle 97 to a second member 134 which extends upwardly from the lower member 132. The lower member 132 extends longitudinally from the upper member 134 so that the convex rollers 104 and 106 are positioned below the pedal 56 and in front of the concave rollers 96 and 98. As with the slider assembly 112, the rollers 96 and 98 of the slider assembly 118 provide lateral stability for the pedal 56 and the front convex rollers 104 and 106 of the slider assembly 118 provide vertical stability for the pedal 56.

Figure 7:
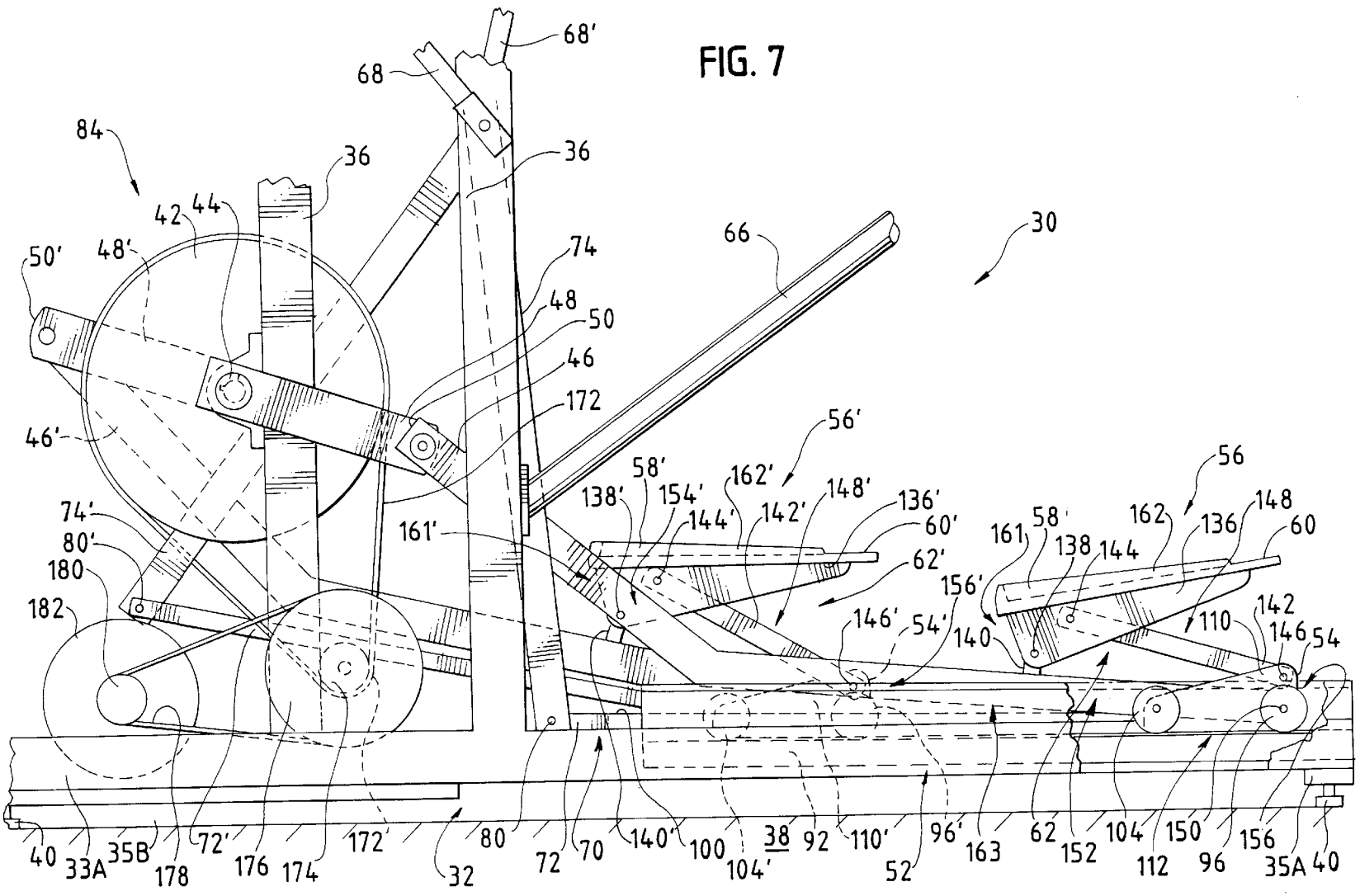
FIG. 7 is a partially cut-away side perspective view of the exercise apparatus in FIG. 1 showing the relative placement of the pedals at one point in the reciprocating path of the second end of the pedal lever which form parts of the exercise apparatus shown in FIG. 1.
Figure 8:
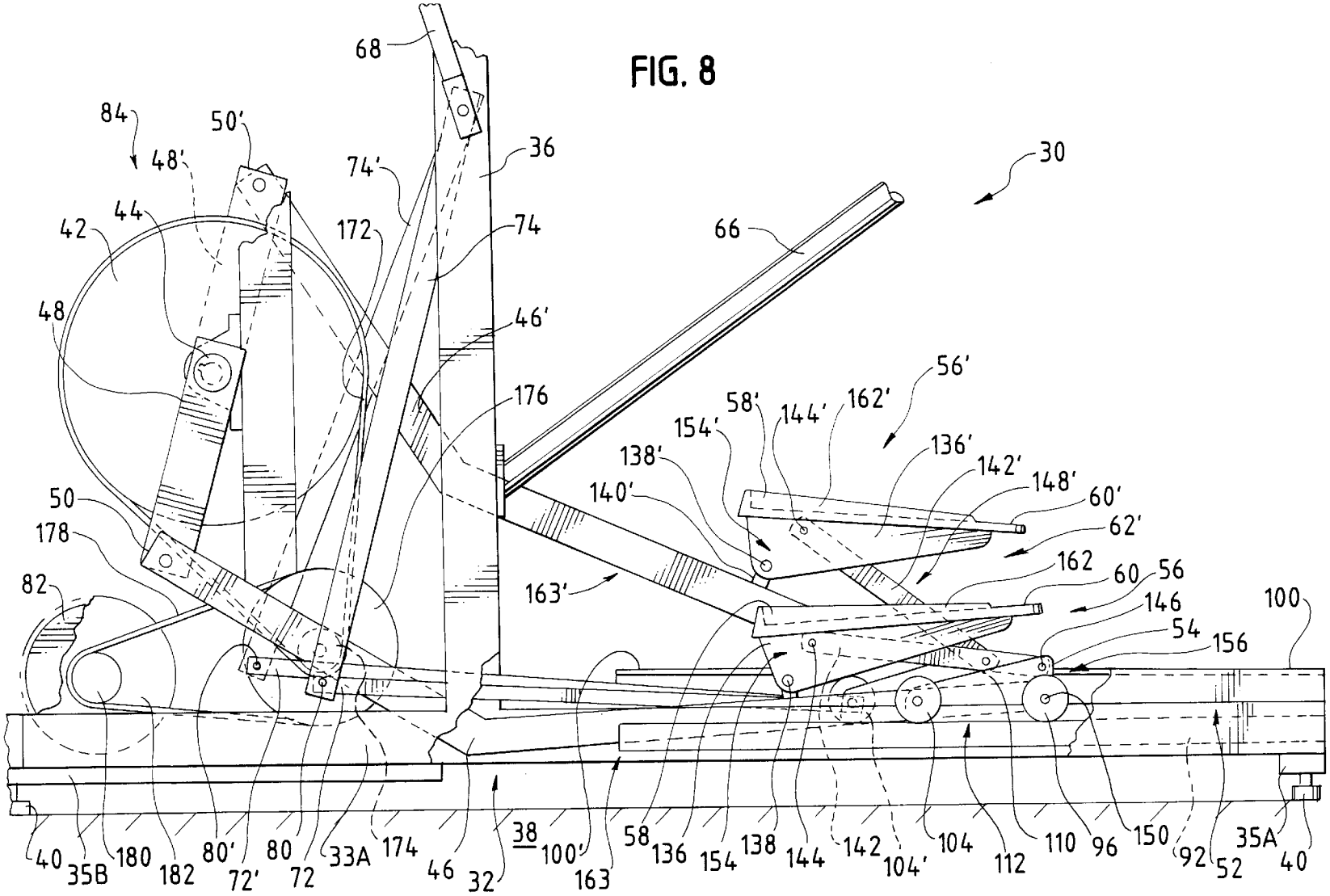
FIG. 8 is a partially cut-away side perspective view of the exercise apparatus in FIG. 1 showing the relative placement of the pedals at a second point in the reciprocating pathway of the second end of the pedal lever.

Turning now to FIGS. 6–8, the pedal 56 includes a vertical member 136 that is coupled to the pedal lever 46 at a first pivot point 138. As shown in FIG. 6, the vertical member 136 preferably is coupled directly to the pedal lever 46 at the first pivot point 138. Alternatively, as shown in FIGS. 7 and 8 a link arm 140 extends from the pedal lever 46 and the vertical member 136 is pivotally secured to the link arm 140 at the first pivot point 138. The linkage assembly 62 includes a pedal link 142 that links the pedal 56 to the pedal lever 46. The pedal link 142 is pivotally secured to the vertical member 136 at a second pivot point 144 that is located near the first pivot point 138. The pedal link 142 is also pivotally coupled with the pedal lever 46 at a third pivot point 146 located on the pedal carriages 110 and 130. The location of the second pivot point 144 and the third pivot point 146 define a first link 148 therebetween. The axle 97 of the slider assembly 112 or 118 defines a pivotal slider point 150 and together with the first pivot point 138 define a second link 152 therebetween. A third link 154 is defined by the distance between the first pivot point 138 and the second pivot point 144, and a fourth link 156 is defined by the distance between the third pivot point 146 and the slider point 150.

The vertical member 136, the pedal link 142, and the pedal lever 46, together with the pivot points 138, 144, and 146 and the slider point 150, thus define a four-bar linkage that determines the movement of the pedal 56 relative to a horizontal surface, such as the horizontal plane 158 (shown in FIGS. 6 and 9A–9F) that contains the slider point 150. For example, if the first link 148 and the second link 152 are of equal length and the third link 154 and the fourth link 156 are of equal length, the angle 160 (shown in FIGS. 9A–9F) between the top surface 162 of the pedal 56 and the horizontal plane 158 will not change as the second end 54 of the pedal lever 46 moves in its reciprocating pathway. In the preferred embodiment, however, the angle 160 varies in order to simulate a natural heel to toe flexure. Consequently, in the preferred embodiment the lengths of the first link 148 and the second link 152 are unequal and are chosen such that the angular displacement of the top surface 162 of the pedal 56, relative to the horizontal plane 158, simulates a natural heel to toe flexure as the second end 54 of the pedal lever 46 moves in its reciprocating pathway. Specifically, in the preferred embodiment the length of the first link 148 is 9.5 inches, the length of the second link 152 is 12 inches, the length of the third link 154 is 3.5 inches and the length of the fourth link 156 is 2 inches. These predetermined lengths result in the angular displacement of the top surface 162 relative to the horizontal plane 158 shown in FIGS. 9A–9F.

FIGS. 9A–9F illustrate the reciprocating pathway of the second end 54 of the pedal lever 46 and show the motion of the pedal 56 as the second end 54 travels along the reciprocating path. The second end 54 of the pedal lever 46 can be moved in two modes that simulate a forward stepping motion and a backward stepping motion, respectively. When the second end 54 is moved in the forward stepping mode, the second end 54 travels sequentially through the positions shown in FIGS. 9A–9F.

Figure 9A:
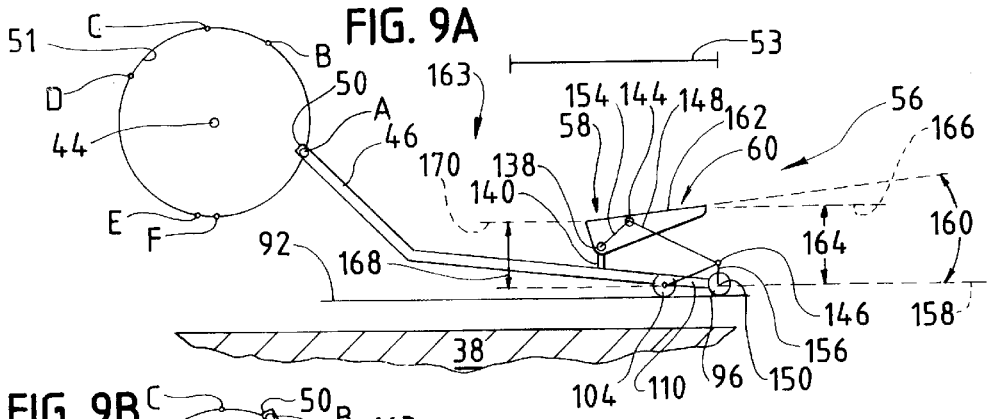
FIGS. 9A–9F are schematic representations of the reciprocating pathway of the second end of the pedal lever.
Figure 9B:
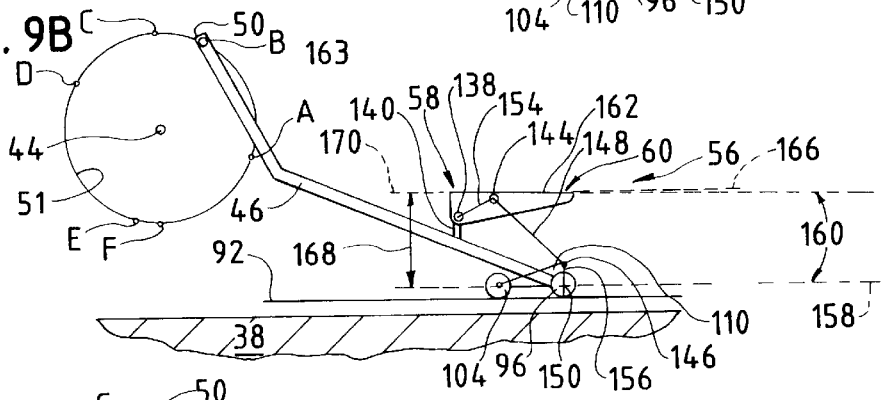
Figure 9C:
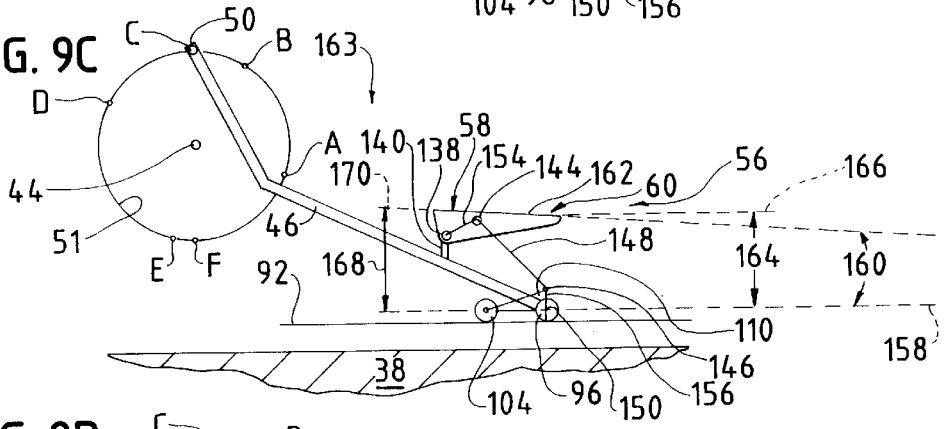
Figure 9D:
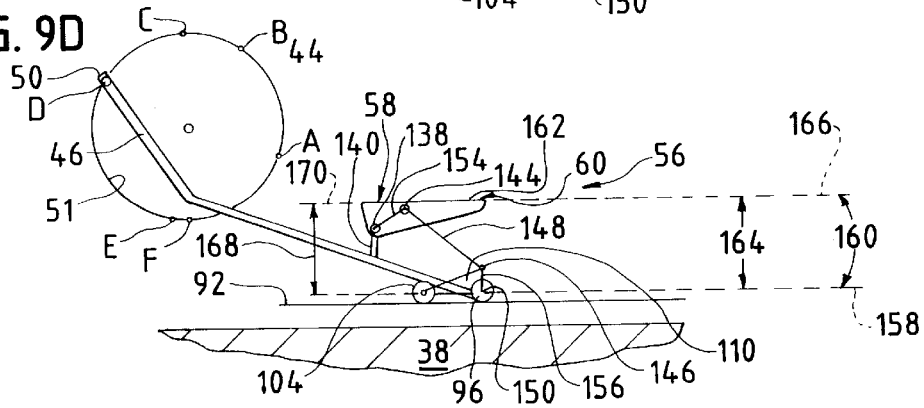
Figure 9E:
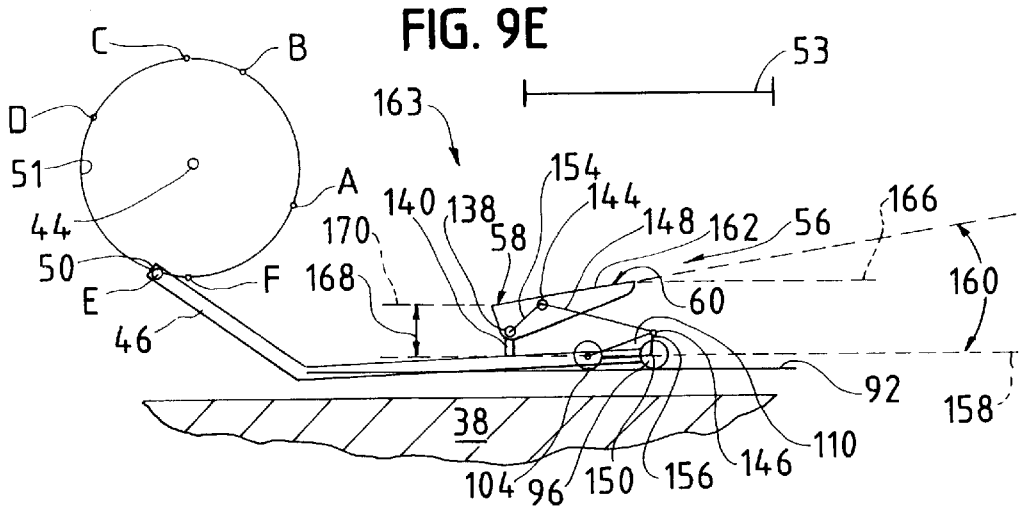
Figure 9F:
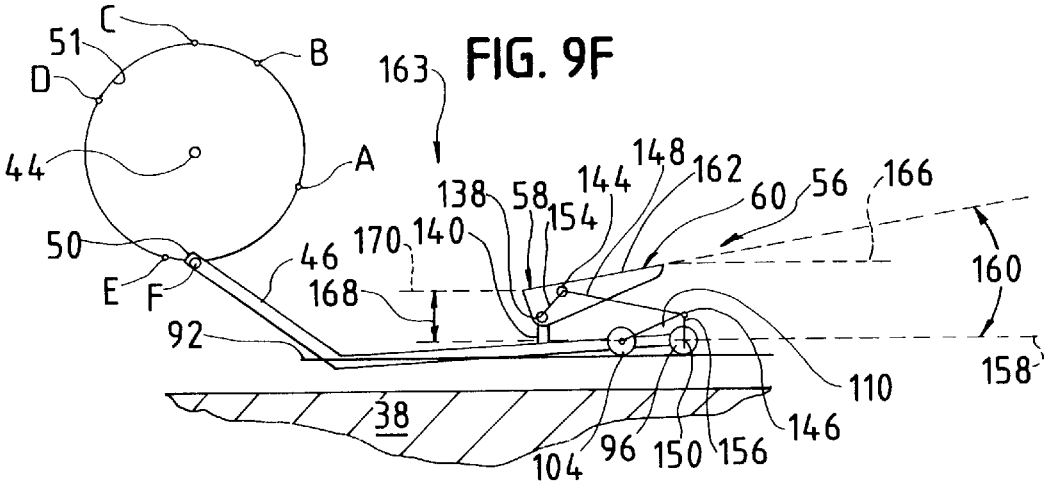

In FIG. 9A, the second end 54 of the pedal lever 46 is at the rearmost position in its reciprocating pathway. In this position, the angular displacement of the top surface 162 relative to the horizontal plane 158 preferably is positive and so the heel portion 60 is elevated above the toe portion 58. If the previously described lengths of the links 148, 152, 154, and 156 are used, the displacement angle 160 of the top surface 162 is +6.0°. In addition, the distance 164 between the plane 158 and a horizontal plane 166 that intersects the heel portion 60 of the pedal 56 is 7.68 inches and the distance between the plane 158 and a horizontal plane 170 that intersects the toe portion 58 is 6.29 inches. Referring to FIG. 7, the pedal 56 corresponding to the user's left foot is approximately located at the position shown in FIG. 9A. In FIG. 9B, the first end 50 of the pedal lever 46 has moved in its arcuate pathway from position A to position B. Concurrently, the second end 54 of the pedal lever 46 has moved toward the pivot axis 44. As the second end 54 moves toward the pivot axis 44 when the second end 54 is manipulated in the forward stepping mode, the angular displacement of the top surface 162 preferably becomes negative so that the heel portion 60 is lowered below the toe portion 58. If the previously described lengths of the links 148, 152, 154, and 156 are used, the displacement angle 160 of the top surface 162 at this position is −2.37°. In addition the distance 164 between the horizontal heel plane 166 and the plane 158 is 9.03 inches and the distance 168 between the horizontal toe plane 170 and the plane 158 is 9.57 inches. Referring to FIG. 8, the pedal 56' corresponding to the user's right foot is approximately located in the position shown in FIG. 9B. As the first end 50 continues in its arcuate pathway to from position B to position C, the heel portion 60 is lowered even further below the toe portion 58. At this position, shown in FIG. 9C, the second end 54 has traveled about two-thirds of the distance in its reciprocating pathway towards the pivot axis 44. If the previously described lengths of the links 148, 152, 154, and 156 are used, the displacement angle 160 of the top surface 162 at this position is −3.46°. In addition, the distance 164 between the horizontal heel plane 166 and the plane 158 is 9.1 inches and the distance 168 between the horizontal toe plane 170 and the plane 158 is 9.91 inches. In FIG. 9D, the second end 54 of the pedal lever 46 has moved to the front-most position in its reciprocating pathway, concurrent with the movement of the first end 50 in its arcuate pathway to from position C to position D. At this location, the angular displacement of the top surface 162 preferably is about zero so that the top surface 162 is substantially level. If the previously described lengths of the links 148, 152, 154, and 156 are used, the displacement angle 160 of the top surface 162 at this position is +0.90°. Additionally, the distance 164 between the horizontal heel plane 166 and the plane 158 is 8.67 inches and the distance 168 between the horizontal toe plane 170 and the plane 158 is 8.47 inches. Referring to FIG. 7, the pedal 56' corresponding to the user's right foot is approximately located in the position shown in FIG. 9D. In FIGS. 9E and 9F, the second end 54 of the pedal lever 46 moves in its reciprocating pathway away from the pivot axis 44. As the second end 54 is manipulated in the forward stepping mode and travels away from the pivot axis 44, the angular displacement of the top surface 162 preferably is positive so that the heel portion 60 is elevated above the toe portion 58. If the previously described lengths of the links 148, 152, 154, and 156 are used, the displacement angle 160 of the top surface 162 is +9.23° at a location that is about one-third the path away from the pivot axis 44, as shown in FIG. 9E. In addition, the distance 164 between the horizontal heel plane 166 and the plane 158 is 6.62 inches and the distance 168 between the horizontal toe plane 170 and the plane 158 is 4.49 inches.

Referring to FIG. 8, the pedal 56 corresponding to the user's left foot is approximately located in the position shown in FIG. 9E. If the previously described lengths of the links 148, 152, 154, and 156 are used, the displacement angle 160 of the top surface 62 is +9.39° when the second end 54 has traveled about two-thirds of the way in its reciprocating pathway away from the pivot axis 44, as shown in FIG. 9F. In addition, the distance 164 between the horizontal heel plane 166 and the plane 158 is 6.55 inches and the distance 168 between the horizontal toe plane 170 and the plane 158 is 4.39 inches. Thus, when the second end 54 is manipulated in the forward stepping mode, the heel portion 60 is lowered below the toe portion 58 as the second end 54 moves toward the pivot axis 44, as shown in FIGS. 9A–9C, and the heel portion 60 is raised above the toe portion 58 as the second end 54 moves away from the pivot axis 44, as shown in FIGS. 9D–9F.

When the second end 54 is manipulated in the backward stepping mode, the sequence of positions of the second end 54 is reversed relative to the sequence followed when the second end 54 is manipulated in the forward stepping mode. Starting again at the rearmost position shown in FIG. 9A, as the second end 54 moves toward the pivot axis 44, the first end 50 moves an its arcuate path from position A to position F to position E and finally to position D. Concurrently, position of the second end 54 and the pedal 56 changes from that shown in FIG. 9A to those shown in FIGS. 9F–9D, respectively. Consequently, when the second end 54 is manipulated in the backward stepping mode, the heel portion 60 is raised above the toe portion 60 as the second end 54 moves toward the pivot axis 44. When the first end 50 continues in its arcuate path from position D to position C on to position B and finally back to position A, the position of the second end 54 changes from that shown in FIG. 9D to those shown in FIGS. 9C–9A, respectively. Thus, as the second end 54 moves away from the pivot axis 44 the heel portion 60 is raised above the toe portion 58 when the second end is manipulated in the backward stepping mode.

Figure 10:
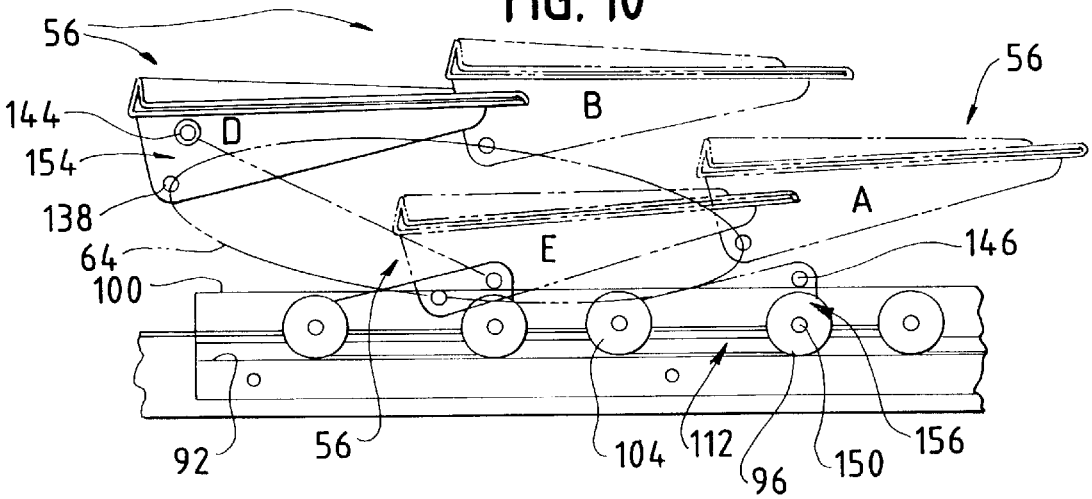
FIG. 10 is an illustration of the elliptical pathway traced by the pedal as the second end of the pedal lever completes the reciprocating path of travel shown in FIGS. 9A–9F.

FIG. 10 traces the elliptical path 64 that the pedal 56 follows as the second end 54 of the pedal lever 46 completes the reciprocating pathway shown in FIGS. 9A–9F. When the second end 54 of the pedal lever 46 is at the rear-most position in the reciprocating pathway, as shown in FIG. 9A, the pedal 56 is positioned at a longitudinal edge position on the elliptical path 64. This position corresponds to the pedal 56 located at position A in FIG. 10. When the second end 54 of the pedal lever 56 is manipulated in the forward stepping mode, as the second end 54 of the pedal lever 46 moves forward, toward the pivot axis 44, the pedal 56 moves upwardly along the elliptical path 64. Thus, for example, when the pedal lever 46 is in the position shown in FIG. 9B, the pedal 56 is approximately located at the position labeled B in FIG. 8. Conversely, when the second end 54 is manipulated in the backward stepping mode, the pedal 56 moves along the elliptical path 64 from position A in FIG. 10 to position E in FIG. 10. The position labeled D in FIG. 10 indicates the location of the pedal 56 on the elliptical path 64 when the second end 54 of the pedal lever 46 is at the front-most position in the reciprocating path, as shown in FIG. 9D. When the second end 54 of the pedal lever 46 is manipulated in the forward stepping mode, as the second end 54 of the pedal lever 46 moves rearward, away from the pivot axis 44, the pedal 56 moves downwardly along the elliptical path 64. For example, when the pedal lever 46 is at the position shown in FIG. 9E, the pedal 56 is approximately located at the position labeled E in FIG. 10. In contrast, when the second end 54 is manipulated in the backward stepping mode, the location of the pedal 56 along the elliptical path 64 changes from position D to position B as the second end 54 moves away from the pivot axis 44.

In the preferred embodiment, as the pedal 56 moves along the elliptical path 64 the uneven four-bar linkage defined by the pivot points 138, 144, and 146, the slider point 150, the pedal arm 142, and a portion of the pedal lever 46 thus permits the angular displacement of the top surface 162 of the pedal 56, relative to the horizontal plane 158, to vary in order to simulate a natural heel to toe flexure. In the forward stepping mode, the pedal 56 moves upward along the elliptical path 64, for example, to position B in FIG. 10, and concurrently the heel portion 60 is lowered below the toe portion 58, as shown in FIGS, 9B and 9C. By lowering the heel portion 60 below the toe portion 58, the user's weight is distributed in a manner similar to that which occurs when the user begins a non-assisted forward stepping motion. In the second part of the forward stepping mode, the pedal 56 moves downward along the elliptical path 64, for example, to position E in FIG. 10, and concurrently the heel portion 60 is elevated above the toe portion, as shown in FIGS. 9D and 9E. Consequently, the user's weight is shifted to the toe portion 58 as it would be if the user were completing a non-assisted forward stepping motion. Conversely, in the backward stepping mode the heel portion 60 is raised above the toe portion 58 as the second 54 end of the pedal lever 46 moves toward the pivot axis 44 and the pedal moves from position A in FIG. 10 to position E in FIG. 10. Thus, in the first half of the backward stepping mode, the user's weight is shifted to the toe portion 58 as it would be if the user were beginning a non-assisted backward step. Moreover, in the backward stepping mode the heel portion 60 is lowered below the toe portion 58 as the second 54 end of the pedal lever 46 moves away from the pivot axis 44 and the pedal 56 moves from position D in FIG. 10 to position B in FIG. 10. Thus, in the second half of the backward stepping mode, the user's weight is shifted to the heel portion 60 as it would be if the user were completing a non-assisted backward step.

The exercise apparatus 30 thus provides an elliptical stepping motion that simulates a natural heel to toe flexure. Consequently, the apparatus 30 minimizes stresses due to un-natural flexures, thereby enhancing exercise efficiency and promoting a pleasurable exercise experience. In addition, if the moving arm 68 is used, the apparatus 30 promotes exercise of the user's total body. As noted in the earlier discussion of FIGS. 1 and 2, the arm 68 is linked to the pedal lever 46 by the coupling assembly 70 such that the arm 68 moves backward, away from the pivot axis 44 concurrently with the forward motion of the second end 54. Moreover, when the second end 54 moves backward, away from the pivot axis 44, the arm 68 moves forward towards the pivot axis 44. Consequently, the user's upper body is exercised simultaneously with the user's lower body. Moreover, the movement of the arm 68 generally opposes that of the second end 54 and of the pedal 56, resulting in an exercise gait that simulates a natural stepping gait. However, the handrail 66 can be used if the user desires only to exercise his lower body. The apparatus 30 thus provides a multiplicity of usage modes, thereby also enhancing exercise efficiency and promoting a pleasurable exercise experience.

Figure 11:
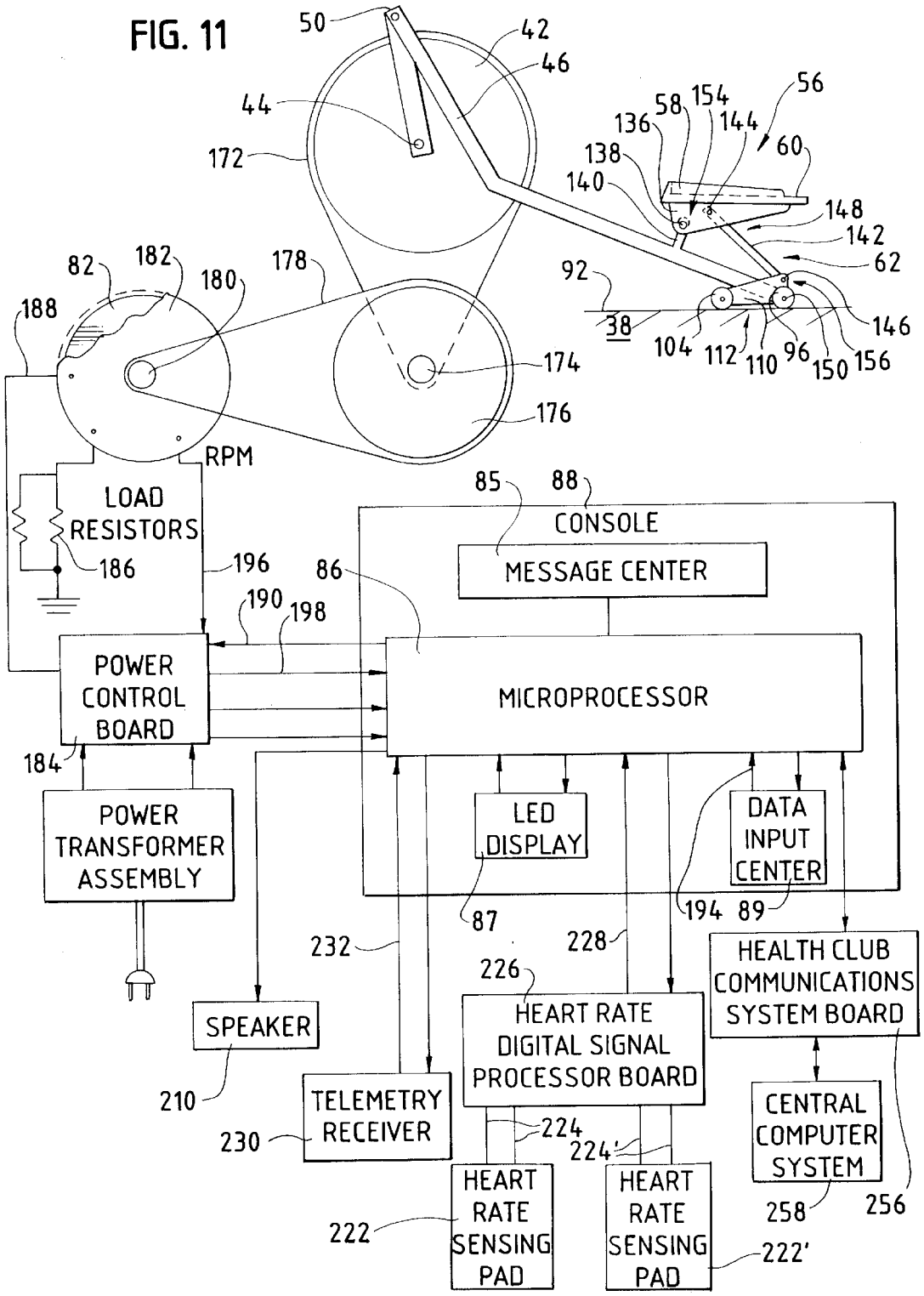
FIG. 11 is a schematic block diagram of the various mechanical and electrical functions of the exercise apparatus shown in FIG. 1.

As noted earlier, the preferred embodiment of the exercise apparatus 30 includes the alternator 82 which, together with the transmission 84, transmits a resistive force to the pedal 56 and to the arm 68. Specifically, as best seen in FIGS. 7 and 8, the transmission includes the pulley 42 which is coupled by a belt 172 to a second pulley 174 that is attached to an intermediate pulley 176. A second belt 178 connects the intermediate pulley 176 to a third pulley 180 that is attached to the flywheel 182 of the alternator 82. The transmission 84 thereby transmits the resistive force provided by the alternator 82 to the pedal 56 and the arm 68 via the pulley 42. Turning to FIG. 11, in the preferred embodiment the microprocessor 86 housed within the console 88 is operatively connected to the alternator 82 via a power control board 184. The alternator 82 is also operatively connected to a ground through a resistance load source 186. A pulse width modulated output signal 188 from the power control board 184 is controlled by the microprocessor 86 and varies the current applied to the field of the alternator 82 by a pre-determined field control signal 190, in order to provide a resistive force which is transmitted to the pedal 56 and to the arm 68. In the preferred embodiment, the output signal 188 is continuously transmitted to the alternator 82, even when the pedal 56 is at rest. Consequently, when the user first steps on the pedal 56 to begin exercising, the braking force provided by the alternator 82 prevents the pedal 56 and the arm 68 from moving unexpectedly. Specifically, when the pedal 56 is at rest, the output signal 188 is set at a pre-determined value which provides the minimum current that is needed to measure the RPM of the flywheel 182. In the presently preferred embodiment, the minimum field current provided by the output signal 188 is 3%–6% of the maximum field current. When the user first steps on the pedal 56, the initial motion of the pedal 56 is detected as a change in the RPM signal 198, whereupon the microprocessor 86 maximizes the field control signal 190 thereby braking the pedal 56 and the arm 68. Thereafter, as explained in more detail below, the resistive force of the alternator 82 is varied by the microprocessor 86 in accordance with the specific exercise program chosen by the user so that the user can operate the pedal 56 as previously described.

Figure 12:
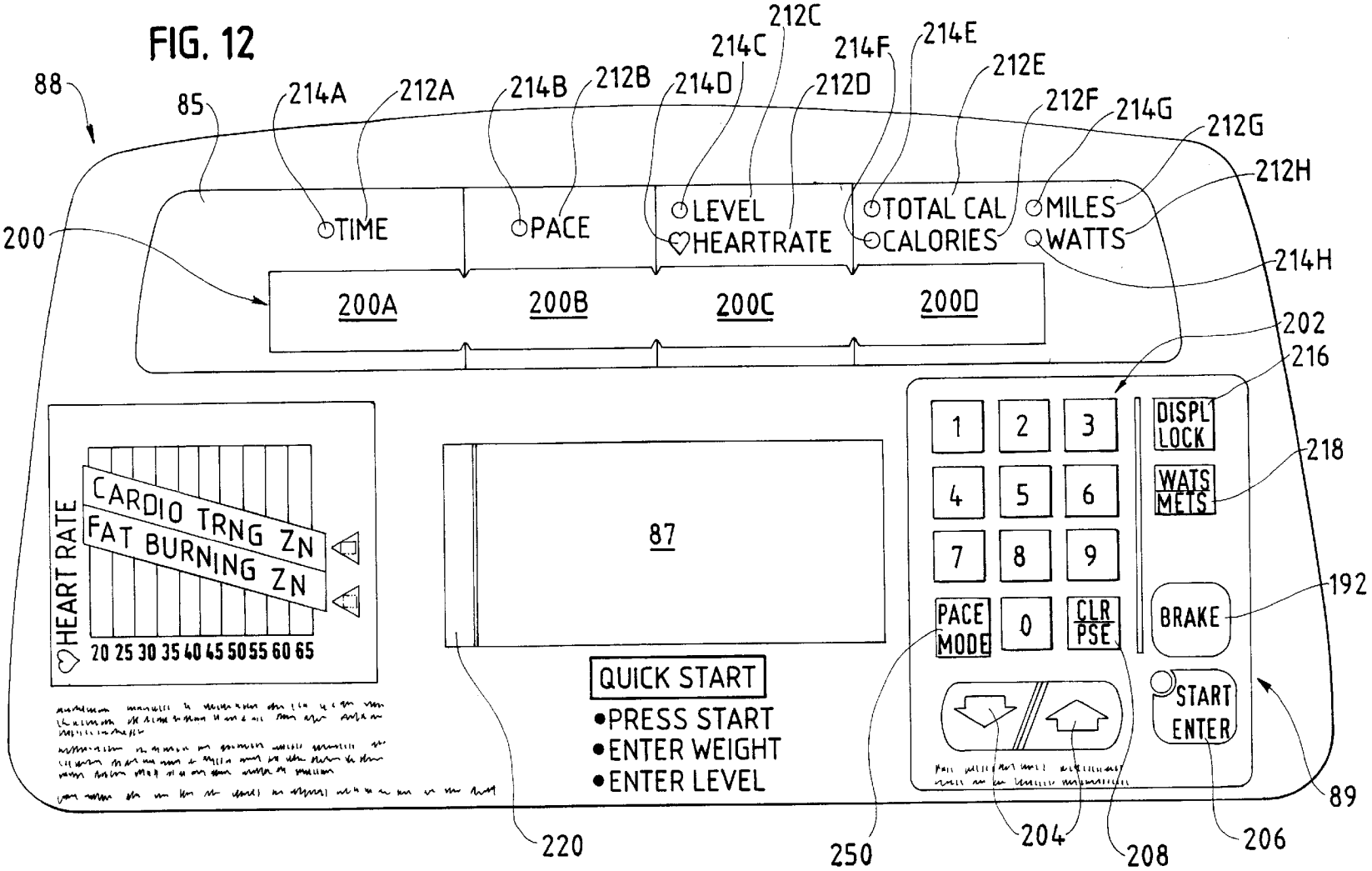
FIG. 12 is a plan layout of the display console of the exercise apparatus shown in FIG. 1.

The alternator 82 and the microprocessor 86 also interact to stop the motion of the pedal 56 when, for example, the user wants to terminate his exercise session on the apparatus 30. The data input center 89, which is operatively connected to the microprocessor 86, includes a brake key 192, as shown in FIG. 12, that can be employed by the user to stop the rotation of the pulley 42 and hence the motion of the pedal 56. When the user depresses the brake key 192, a stop signal is transmitted to the microprocessor 86 via an output signal 194 of the data input center 89. Thereafter, the field control signal 190 of the microprocessor 86 is varied to increase the resistive load applied to the alternator 82. The output signal 196 of the alternator provides a measurement of the speed at which the pedal 56 is moving as a function of the revolutions per minute (RPM) of the alternator 82. A second output signal 198 of the power control board 184 transmits the RPM signal to the microprocessor 86. The microprocessor 86 continues to apply a resistive load to the alternator 82 via the power control board 184 until the RPM equals a pre-determined minimum which, in the preferred embodiment, is equal to or less than 5 RPM.

In the preferred embodiment, the microprocessor 86 can also vary the resistive force of the alternator 82 in response to the user's input to provide different exercise levels. The message center 85 includes an alpha-numeric display panel 200, shown in FIG. 12, that displays messages to prompt the user in selecting one of several pre-programmed exercise levels. In the preferred embodiment, there are twenty-four pre-programmed exercise levels, with level one being the least difficult and level 24 the most difficult. The data input center 89 includes a numeric key pad 202 and selection arrows 204, either of which can be employed by the user to choose one of the pre-programmed exercise levels. For example, the user can select an exercise level by entering the number, corresponding to the exercise level, on the numeric keypad 202 and thereafter depressing the start/enter key 206. Alternatively, the user can select the desired exercise level by using the selection arrows 204 to change the level displayed on the alpha-numeric display panel 200 and thereafter depressing the start/enter key 206 when the desired exercise level is displayed. The data input center 89 also includes a clear/pause key 208 which can be pressed by the user to clear or erase the data input before the start/enter key 206 is pressed. In addition, the exercise apparatus 30 includes a user-feedback apparatus that informs the user if the data entered are appropriate. In the preferred embodiment, the user feed-back apparatus is a speaker 210, shown in FIG. 11, that is operatively connected to the microprocessor 86. The speaker 210 generates two sounds, one of which signals an improper selection and the second of which signals a proper selection. For example, if the user enters a number between 1 and 24 in response to the exercise level prompt displayed on the alpha-numeric panel 200, the speaker 210 generates the correct-input sound. On the other hand, if the user enters an incorrect datum, such as the number 100 for an exercise level, the speaker 210 generates the incorrect-input sound thereby informing the user that the data input was improper. The alpha-numeric display panel 200 also displays a message that informs the user that the data input was improper. Once the user selects the desired appropriate exercise level, the microprocessor 86 transmits a field control signal 190 that sets the resistive load applied to the alternator 82 to a level corresponding with the pre-programmed exercise level chosen by the user.

The message center 85 displays various types of information while the user is exercising on the apparatus 30. As shown in FIG. 12, the alpha-numeric display panel 200 preferably is divided into four sub-panels 200A–D, each of which is associated with specific types of information. Labels 212A–H and LED indicators 214A–H located above the sub-panels 200A–D indicate the type of information displayed in the sub-panels 200A–D. The first sub-panel 200A displays the time elapsed since the user began exercising on the apparatus 30. The second sub-panel 200B displays the pace at which the user is exercising. The third sub-panel 200C displays either the exercise level chosen by the user or, as explained below, the heart rate of the user. The LED indicator 214C associated with the exercise level label 212C is illuminated when the level is displayed in the sub-panel 200C and the LED indicator 214D associated with the heart rate label 212D is illuminated when the sub-panel 200C displays the user's heart rate. The fourth sub-panel 200D displays four types of information: the calories per hour at which the user is currently exercising; the total calories that the user has actually expended during exercise; the distance, in miles or kilometers, that the user has "traveled" while exercising; and the power, in watts, that the user is currently generating. In the default mode of operation, the fourth sub-panel 200D scrolls among the four types of information. As each of the four types of information is displayed, the associated LED indicators 214E–H are individually illuminated, thereby identifying the information currently being displayed by the sub-panel 200D. A display lock key 216, located within the data input center 89, can be employed by the user to halt the scrolling display so that the sub-panel 200D continuously displays only one of the four information types. In addition, the user can lock the units of the power display in watts or in metabolic units ("mets"), or the user can change the units of the power display, to watts or mets or both, by depressing a watts/mets key 218 located within the data input center 89.

In the preferred embodiment of the invention, the exercise apparatus 30 also provides several pre-programmed exercise programs that are stored within and implemented by the microprocessor 86. The different exercise programs further promote an enjoyable exercise experience and enhance exercise efficiency. The alpha-numeric display panel 200 of the message center 85, together with the display panel 87, guide the user through the various exercise programs. Specifically, the alpha-numeric display panel 200 prompts the user to select among the various pre-programmed exercise program and prompts the user to supply the data needed to implement the chosen exercise program. The display panel 87 displays a graphical image that represents the current exercise program. The simplest exercise program is a manual exercise program. In the manual exercise program the user simply chooses one of the twenty-four previously described exercise levels. In this case the graphic image displayed by the display panel 87 is essentially flat and the different exercise levels are distinguished as vertically spaced-apart flat displays. A second exercise program, a so-called hill profile program, varies the effort required by the user in a pre-determined fashion which is designed to simulate movement along a series of hills. In implementing this program, the microprocessor 86 increases and decreases the resistive force of the alternator 82 thereby varying the amount of effort required by the user. The display panel 87 displays a series of vertical bars of varying heights that correspond to climbing up or down a series of hills. A portion 220 of the display panel 87 displays a single vertical bar whose height represents the user's current position on the displayed series of hills. A third exercise program, known as a random hill profile program, also varies the effort required by the user in a fashion which is designed to simulate movement along a series of hills. However, unlike the regular hill profile program, the random hill profile program provides a randomized sequence of hills so that the sequence varies from one exercise session to another. A detailed description of the random hill profile program and of the regular hill profile program can be found in U.S. Pat. No. 5,358,105, the entire disclosure of which is hereby incorporated by reference.

A fourth exercise program, known as a cross training program, urges the user to manipulate the pedal 56 in both the forward stepping mode and the backward stepping mode. When this program is chosen, the user begins moving the pedal 56 in one direction, for example, in the forward direction from position A to position C along the elliptical path 64. After a pre-determined period of time, the alpha-numeric display panel 200 prompts the user to prepare to reverse directions. Thereafter, the field control signal 190 from the microprocessor 86 is varied to effectively brake the motion of the pedal 56 and the arm 68. After the pedal 56 and the arm 68 stop, the alpha-numeric display panel 200 prompts the user to resume his workout. Thereafter, the user reverses directions and resumes his workout in the opposite direction.

Two exercise programs, a cardio program and a fat burning program, vary the resistive load of the alternator 82 as a function of the user's heart rate. When the cardio program is chosen, the microprocessor 86 varies the resistive load so that the use's heart rate is maintained at a value equivalent to 80% of a quantity equal to 220 minus the user's age. In the fat burning program the resistive load is varied so that the user's heart rate is maintained at a value equivalent to 65% of a quantity equal to 220 minus the user's heart age. Consequently, when either of these programs is chosen, the alpha-numeric display panel 200 prompts the user to enter his age as one of the program parameters. Alternatively, the user can enter a desired heart rate. In addition, the exercise apparatus 30 includes a heart rate sensing device that measures the user's heart rate as he exercises. As shown in FIGS. 1, 2, and 9, the heart rate sensing device consists of heart rate sensors 222 that are mounted either on the moving arm 68 or on the fixed hand rail 66. In the preferred embodiment, the sensors 222 are mounted on the moving arm 68. An output signal 224 corresponding to the user's heart rate is transmitted from the sensors 222 to a heart rate digital signal processing board 226. The processing board 226 then transmits a heart rate signal 228 to the microprocessor 86. A detailed description of the sensors 222 and the heart rate digital signal processing board 226 can be found in U.S. Pat. Nos. 5,135,447 and 5,243,993, the entire disclosures of which are hereby incorporated by reference. In addition, the exercise apparatus 30 includes a telemetry receiver 230, shown in FIG. 9, that operates in an analogous fashion and transmits a telemetric heart rate signal 232 to the microprocessor 86. The telemetry receiver 230 works in conjunction with a telemetry transmitter that is worn by the user. In the preferred embodiment, the telemetry transmitter is a telemetry strap worn by the user around the user's chest, although other types of transmitters are possible. Consequently, the exercise apparatus 30 can measure the user's heart rate through the telemetry receiver 230 if the user is not grasping the arm 68. Once the heart rate signal 228 or 232 is transmitted to the microprocessor 86, the resistive load of the alternator 82 is varied to maintain the user's heart rate at the calculated value.

In each of these exercise programs, the user provides data that determine the duration of the exercise program. The user can choose between two exercise goal types, a time goal type and a calories goal type. If the time goal type is chosen, the alpha-numeric display panel 200 prompts the user to enter the total time that he wants to exercise. Alternatively, if the calories goal type is chosen, the user enters the total number of calories that he wants to expend. The microprocessor 86 then implements the chosen exercise program for a period corresponding to the user's goal. If the user wants to stop exercising temporarily after the microprocessor 86 begins implementing the chosen exercise program, depressing the clear/pause key 208 effectively brakes the pedal 56 and the arm 68 without erasing or changing any of the current program parameters. The user can then resume the chosen exercise program by depressing the start/enter key 206. Alternatively, if the user wants to stop exercising altogether before the chosen exercise program has been completed, the user simply depresses the brake key 192 to brake the pedal 56 and the arm 68. Thereafter, the user can resume exercising by depressing the start/enter key 206. In addition, the user can stop exercising by ceasing to move the pedal 56. The user then can resume exercising by again moving the pedal 56.

The exercise apparatus 30 also includes a pace option. In all but the cardio program and the fat burning program, the default mode is defined such that the pace option is on and the microprocessor 86 varies the resistive load of the alternator 82 as a function of the user's pace. When the pace option is on, the magnitude of the RPM signal 198 received by the microprocessor 86 determines the percentage of time during which the field control signal 190 is enabled and thereby the resistive force of the alternator 82. In general, the instantaneous velocity as represented by the RPM signal 198 is compared to a predetermined value to determine if the resistive force of the alternator 82 should be increased or decreased. In the presently preferred embodiment, the pre-determined value is a constant of 30 RPM. Alternatively, the pre-determined value could vary as a function of the exercise level chosen by the user. Thus, in the presently preferred embodiment, if the RPM signal 198 indicates that the instantaneous velocity of the pulley 48 is greater than 30 RPM, the percentage of time that the field control signal 190 is enabled is increased according to Equation 1.

Equation 1

$$\text{field control duty cycle} = \text{field control duty cycle} + \frac{((|\text{instantaneous RPM} - 30|)/2)^2 * \text{field control duty cycle})}{256}$$

where field duty cycle is a variable that represents the percentage of time that the field control signal 190 is enabled and where the instantaneous RPM represents the instantaneous value of the RPM signal 198.

On the other hand, in the presently preferred embodiment, if the RPM signal 198 indicates that the instantaneous velocity of the pulley 48 is less than 30 RPM, the percentage of time that the field control signal 190 is enabled is decreased according to Equation 2.

Equation 2

$$\text{field control duty cycle} = \text{field control duty cycle} - \frac{((|\text{instantaneous RPM} - 30|)/2)^2 * \text{field control duty cycle})}{256}$$

where field duty cycle is a variable that represents the percentage of time that the field control signal 190 is enabled and where the instantaneous RPM represents the instantaneous value of the RPM signal 198.

Figure 13:
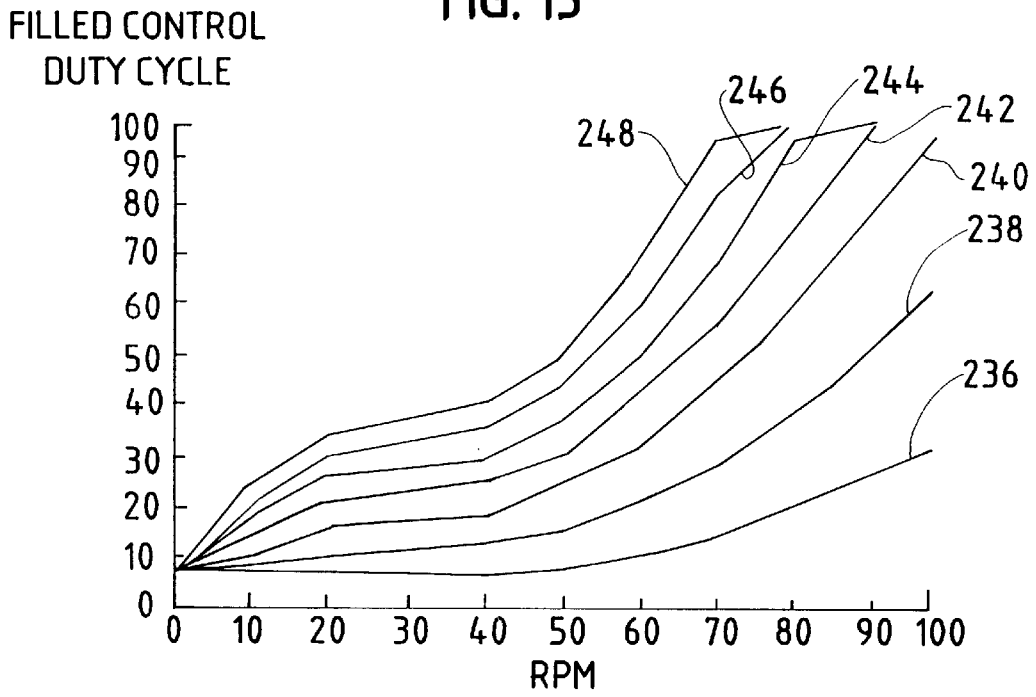

Moreover, once the user's chooses an exercise level, the initial percentage of time that the field control signal 190 is enabled is pre-programmed as a function of the chosen exercise level. Consequently, in the presently preferred embodiment, the pace option provides a family of curves that determine the resistive force of the alternator 82 as a function of the exercise level chosen by the user and as a function of the user's pace. FIG. 13 illustrates some of the curves 236–248 which are used by the microprocessor 86 to control the resistive force of the alternator 82 when the pace mode option is on. Curve 236 represents the percentage of time that the field control signal 190 is enabled when the first exercise level, level 1, is chosen by the user. Similarly, curve 238 corresponds to exercise level 4, curve 240 corresponds to exercise level 7, curve 242 corresponds to exercise level 10, curve 244 corresponds to exercise level 13, curve 246 corresponds to exercise level 16, and curve 248 corresponds to exercise level 19. In addition, there are other curves (not shown) that correspond with the remaining levels of the twenty-four exercise levels that are provided in the preferred embodiment.

Figure 14:
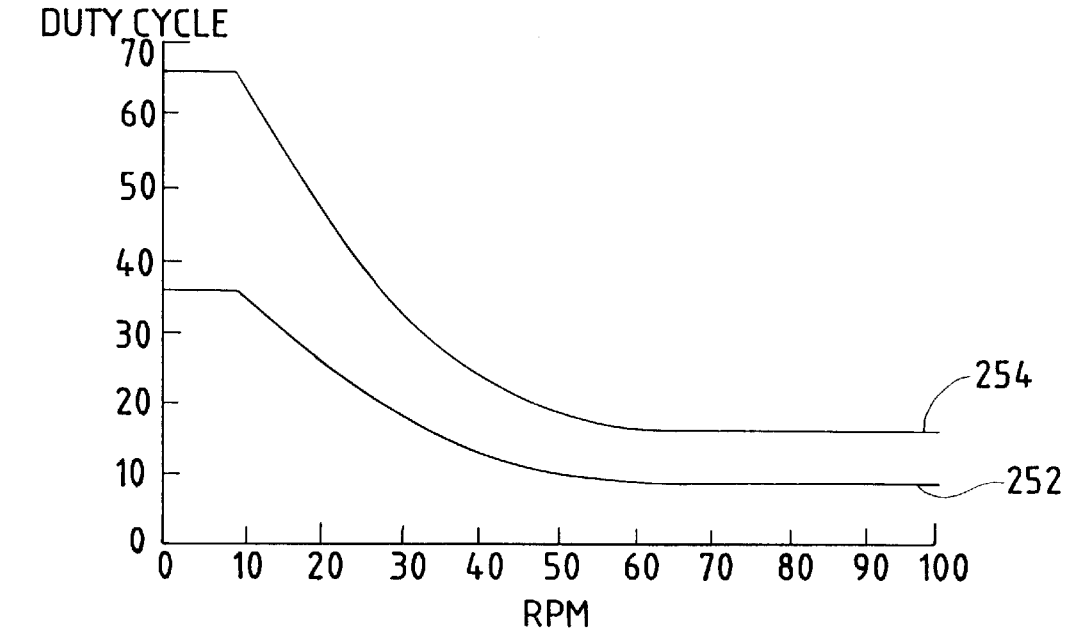
FIG. 14 is a graph of the percentage of time that the field control signal is enabled vs. the RPM signal when the exercise apparatus in FIG. 1 is used with the pace mode off or the exercise apparatus of FIG. 1 is used with the cardio or fat burning programs.

The user can disable the pace option, so that the resistive load of the alternator 82 varies as per FIG. 14, by depressing a pace mode key 250 located within the data input center 89. In addition, in the cardio program and the fat burning program, the pace mode default is set so that the pace mode is off. When the pace mode is disabled or when the user has chosen either the cardio or fat burning programs, the microprocessor 86 varies the time that the field control signal 190 is enabled primarily as a function of the exercise level chosen by the user and so that the percentage of time that the field control signal 190 is enabled is not less than a pre-determined minimum value and is not greater than a pre-determined maximum value. The pre-determined minimum value for the percentage of time that the field control signal 190 is enabled corresponds with the minimum value that is required to measure the RPM of the pulley 48. In the presently preferred embodiment, this pre-determined minimum value is 6%. In addition, the maximum percentage of time that the field control signal 190 is enabled is 100% in the presently preferred embodiment.

Initially, the microprocessor 86 compares the instantaneous RPM of the pulley 48 to a pre-determined minimum value which, in the presently preferred embodiment is 15 RPM. If the instantaneous RPM of the pulley 48 is greater than or equal to 15 RPM, the value of the instantaneous RPM is assigned to a RPM variable. If, however, the instantaneous value of the RPM is less than 15 RPM, the RPM variable is set to equal 15 RPM, according to Equations 3 and 4.

Equation 3

$$\text{working RPM} = \text{instantaneous RPM}$$

Equation 4

$$\text{if working RPM} < 15 \text{ RPM, working RPM} = 15 \text{ RPM}$$

where the instantaneous RPM is the instantaneous value of the RPM signal 198 and where working RPM is the RPM variable.

The microprocessor 198 then determines a value for the percentage of time that the field control signal 190 is enabled as a function of both the exercise level chosen by the user and the value of the RPM variable, according to Equation 5:

Equation 5

$$\text{field duty cycle} = \frac{(30 * \text{base field})}{\text{working RPM}}$$

where field duty cycle is a variable that represents the percentage of time that field control signal 190 is enabled and base field is the pre-determined initial value for the percentage of time that field control signal 190 is enabled based on the exercise level chosen by the user.

The value for the percentage of time that the field control signal 190 is enabled, the field duty cycle variable, is then compared to two different predetermined values. First, the field duty cycle variable is compared to the initial value for the amount of time the field control signal 190 is enabled and the field duty cycle variable is re-assigned if appropriate, according to Equation 6:

Equation 6

$$\text{IF (field duty cycle)} < \frac{\text{base field}}{2} \text{ then (field duty cycle)} = \frac{\text{base field}}{2}$$

where field duty cycle is the variable that represents the percentage of time that field control signal 190 is enabled and base field is the pre-determined initial value for the percentage of time that field control signal 190 is enabled based on the exercise level chosen by the user.

Finally, the field duty cycle variable is compared to the pre-determined minimum value and the predetermined maximum value and is re-assigned if appropriate, according to Equations 7 and 8:

Equation 7

If (field duty cycle<minimum value) then field duty cycle=minimum value

Equation 8

If (field duty cycle>maximum value) then field duty cycle=maximum value where field duty cycle is the variable that represents the percentage of time that field control signal 190 is enabled and where, in the presently preferred embodiment, the minimum value is 6% and the maximum value is 100%.

Thus, when the pace mode is off or when the user has chosen either the cardio program or the fat burning program, the microprocessor 86 varies the resistive force of the alternator 82, via the percentage of time that the field control signal 190 is enabled, so that the resistive force does not drop below one-half of the value that corresponds to the chosen exercise level and does not exceed two times the value that corresponds to the chosen exercise level. Consequently, the preferred embodiment of the apparatus 30 provides a family of curves that determine the percentage of time that the field control signal 190 enabled primarily as a function of the exercise level chosen by the user. FIG. 14 illustrates two of the curves 252–254 which are used by the microprocessor 86 to control the resistive force of the alternator 82 when the pace mode option is on. Curve 252 represents the percentage of time that the field control signal 190 is enabled when the seventh first exercise level, level 7, is chosen by the user. Similarly, curve 254 corresponds to exercise level 16. In addition, there are other curves (not shown) that correspond with the remaining levels of the twenty-four exercise levels that are provided in the preferred embodiment.

The preferred embodiment of the apparatus 30 further includes a communications board 256 that links the microprocessor 86 to a central computer 258, as shown in FIG. 11. Once the user has entered the preferred exercise program and associated parameters, the program and parameters can be saved in the central computer 258 via the communications board 256. Thus, during subsequent exercise sessions, the user can retrieve the saved program and parameters and can begin exercising without re-entering data. In addition, at the conclusion of an exercise session, the user's heart rate, distance traveled, and total calories expended can be saved in the central computer 258 for future reference.

In use, the user begins his exercise session by first stepping on the pedal 56 which, as previously explained, is heavily damped due to the at-rest resistive force of the alternator 82. Once the user depresses the start/enter key 206, the alpha-numeric display panel 200 of the message center 85 prompts the user to enter the required information and to select among the various programs. First, the user is prompted to enter the user's weight. The alpha-numeric display panel 200, in conjunction with the display panel 87, then lists the exercise programs and prompts the user to select an program. Once an program is chosen, the alpha-numeric display panel 200 then prompts the user to provide program-specific information. For example, if the user has chosen the cardio program, the alpha-numeric display panel 200 prompts the user to enter the user's age. After the user has entered all the program-specific information, the user is prompted to specify the goal type (time or calories), to specify the desired exercise duration in either total time or total calories, and to choose one of the twenty-four exercise levels. Once the user has entered all the required parameters, the microprocessor 86 implements the chosen exercise program based on the information provided by the user. When the user then operates the pedal 56 in the previously described manner, the angular displacement of the pedal 56 changes, as the pedal moves along the elliptical pathway 64, in order to simulate a natural heel to toe flexure that minimizes or eliminates stresses due to unnatural flexures. If the user employs the moving arm 68, the exercise apparatus 30 exercises the user's upper body concurrently with the user's lower body. Alternatively, the user can concentrate his exercise session on his lower body by using the handrails 66. The exercise apparatus 30 thus provides a wide variety of exercise programs that can be tailored to the specific needs and desires of individual users, and consequently, enhances exercise efficiency and promotes a pleasurable exercise experience.

Although the present invention has been described with reference to preferred embodiments, it will be understood that various changes and modifications will be suggested to one skilled in the art and it is intended that the invention encompass such changes and modifications as fall within the scope of the appended claims.

What is claimed is:

1. An exercise apparatus comprising:

a frame;

a pivot axis supported by said frame;

a pedal lever;

a coupler for pivotally coupling a first end of said pedal lever to said pivot axis at a predetermined distance from said pivot axis such that said first end moves in an arcuate pathway around said pivot axis;

a guide member supported by said frame and engaging a second end of said pedal lever such that said second end of said pedal lever moves in a reciprocating pathway as said first end of said pedal lever moves in said arcuate pathway;

a pedal having a toe portion and a heel portion a pedal arm pivotally secured to said second end of said pedal lever and pivotally secured to said pedal at a location proximate to said toe portion such that said toe portion is intermediate said heel portion; and intermediate coupling means for pivotally coupling said pedal to said pedal lever at a location intermediate said second end of said pedal lever and said pivot axis such that said heel portion is raised above said toe portion when said second end moves in said reciprocating pathway in a direction away from said pivot axis.

2. The exercise apparatus of claim 1 wherein said intermediate coupling means includes a link arm extending from said pedal lever and pivotally secured to said pedal.

3. The exercise apparatus of claim 1 further including a handrail rigidly secured to said frame.

4. The exercise apparatus of claim 1 further including an arm and coupling means for coupling said arm to said pedal lever such that said arm moves toward said second end of said pedal lever when said second end of said pedal lever moves in said reciprocating pathway in a direction towards said pivot axis.

5. The exercise apparatus of claim 4 further including a handrail rigidly secured to said frame.

6. The exercise apparatus of claim 1 further including resistance means secured to said frame for applying a resistance force to said pedal and transmission means operatively connected to said resistance means and said pivot axis for transmitting said resistance force to said pedal.

7. The exercise apparatus of claim 6 wherein said resistance means includes an alternator.

8. The exercise apparatus of claim 1 wherein said guide member includes a first longitudinal track secured to said frame and configured to support said second end of said pedal lever.

9. The exercise apparatus of claim 8 further including a first roller secured to said pedal lever and resting on said first longitudinal track.

10. The exercise apparatus of claim 9 wherein said guide member further includes a second longitudinal track aligned with said first longitudinal track and positioned above said first longitudinal track, said first and second longitudinal tracks being configured to engage said first roller.

11. The exercise apparatus of claim 10 wherein said first longitudinal track has a substantially arcuate cross section.

12. The exercise apparatus of claim 11 wherein said first roller is concave.

13. The exercise apparatus of claim 10 further including a second roller affixed to said pedal lever, aligned with said first roller, and engaged by said first and second tracks.

14. The exercise apparatus of claim 13 wherein said first longitudinal track has a substantially arcuate cross section.

15. The exercise apparatus of claim 14 wherein said first roller is concave.

16. The exercise apparatus of claim 14 wherein said second roller is convex.

17. The exercise apparatus of claim 10 wherein said frame further includes a vertical support member positioned intermediate said pivot axis and said second end of said pedal lever.

18. The exercise apparatus of claim 17 further including a handrail rigidly secured to said vertical support member.

19. The exercise apparatus of claim 17 further including a first arm link pivotally coupled with said pedal lever proximate to said second end and extending toward said pivot axis, a second arm link pivotally coupled to said first arm link and extending from said first arm link toward said vertical support member, an arm, and a shaft rigidly secured to said second arm link, rotatably supported by said vertical support member, and rigidly secured to said arm, said arm moving toward said second end of said pedal lever when said second end of said pedal lever moves in said reciprocating pathway in a direction towards said pivot axis.

20. The exercise apparatus of claim 19 further including a handgrip secured to said arm and extending from said arm at a predetermined angle.

21. The exercise apparatus of claim 19 further including a handrail rigidly secured to said vertical support member.

22. The exercise apparatus of claim 9 further including a second roller secured to said pedal lever and wherein said guide member further includes a second longitudinal track laterally spaced apart from said first longitudinal track and configured to engage said second roller.

23. The exercise apparatus of claim 22 wherein said guide member further includes third and fourth tracks, said third track being aligned with said first longitudinal track and positioned above said first longitudinal track, said fourth track being aligned with and positioned above said second longitudinal track.

24. The exercise apparatus of claim 23 further including third and fourth rollers affixed to said pedal lever, said third roller being engaged by said first and third tracks and said fourth roller being engaged by said second and fourth tracks.

25. The exercise apparatus of claim 24 wherein each of said first and second tracks has a substantially arcuate cross section.

26. The exercise apparatus of claim 25 wherein said first and second rollers are concave.

27. The exercise apparatus of claim 22 wherein said frame further includes a vertical support member positioned intermediate said pivot axis and said second end of said pedal lever.

28. The exercise apparatus of claim 27 further including a handrail rigidly secured to said vertical support member.

29. The exercise apparatus of claim 27 further including a first arm link pivotally located between said first and third tracks, coupled with said pedal lever proximate to said second end, and extending toward said pivot axis, a second arm link pivotally coupled to said first arm link and extending from said first arm link toward said vertical support member, an arm, and a shaft rigidly secured to said second arm link, rotatably supported by said vertical support member, and rigidly secured to said arm, said arm moving toward said second end of said pedal lever when said second end of said pedal lever moves in said reciprocating pathway in a direction towards said pivot axis.

30. The exercise apparatus of claim 29 further including a handgrip secured to said arm and extending from said arm at a predetermined angle.

31. The exercise apparatus of claim 29 further including a handrail rigidly secured to said vertical support member.

32. The exercise apparatus of claim 1 further including a first cross member and a second cross member and wherein said guide member includes a first longitudinal track secured to said first and second cross members and configured to support said second end of said pedal lever.

33. The exercise apparatus of claim 32 further including a first roller rotatably coupled with said pedal lever and resting on said first longitudinal track.

34. The exercise apparatus of claim 33 further including a second roller and wherein said guide member further includes a second longitudinal track, said second longitudinal track being positioned above said first longitudinal track, said second roller being rotatably coupled with said pedal lever and resting on said second longitudinal track.

35. The exercise apparatus of claim 34 further including an arm and coupling means for coupling said arm to said pedal lever such that said arm moves toward said second end of said pedal lever when said second end of said pedal lever moves in said reciprocating pathway in a direction towards said pivot axis.

36. The exercise apparatus of claim 34 wherein said second longitudinal track has a substantially arcuate cross section and wherein said second roller is concave.

37. The exercise apparatus of claim 36 further including a third roller and wherein said guide member further includes a third longitudinal track, said third longitudinal track being positioned above said first longitudinal track and having a substantially arcuate cross section, said third roller being concave, laterally spaced apart from said second roller, rotatably coupled with said pedal lever, and resting on said third longitudinal track.

38. The exercise apparatus of claim 37 further including a fourth roller being rotatably coupled with said pedal lever, laterally spaced apart from said first roller, and resting on said first longitudinal track.

39. The exercise apparatus of claim 38 further including an arm and coupling means for coupling said arm to said pedal lever such that said arm moves toward said second end of said pedal lever when said second end of said pedal lever moves in said reciprocating pathway in a direction towards said pivot axis.

40. An exercise apparatus comprising:

a frame;

a pivot axis supported by said frame;

a pedal lever;

a coupler for pivotally coupling a first end of said pedal lever to said pivot axis at a predetermined distance from said pivot axis such that said first end moves in an arcuate pathway around said pivot axis;

a guide member supported by said frame and engaging a second end of said pedal lever such that said second end of said pedal lever moves in a reciprocating pathway as said first end of said pedal level moves in said arcuate pathway;

a pedal spaced apart from said pedal lever including a vertical member pivotally connected to said pedal lever at a first pivot point; and linkage means, including a pedal link and slider means, said pedal link being pivotally coupled to said vertical member at a second pivot point and pivotally coupled to said pedal lever at a third pivot point to define a first link having a predetermined length between said second and third pivot points, said slider means be affixed to said pedal lever at a predetermined slider point to define a second link having a predetermined length between said first pivot point and said slider point, for linking said pedal to said pedal lever such that said pedal travels in a substantially elliptical pathway as said first end of said pedal lever moves in said arcuate pathway.

41. The exercise apparatus of claim 40 further including a handrail rigidly secured to said frame.

42. The exercise apparatus of claim 40 further including an arm and coupling means for coupling said arm to said pedal lever such that said arm moves toward said second end of said pedal lever when said second end of said pedal lever moves in said reciprocating pathway in a direction towards said pivot axis.

43. The exercise apparatus of claim 42 further including a handrail rigidly secured to said frame.

44. The exercise apparatus of claim 41 further including resistance means secured to said frame for applying a resistance force to said pedal and transmission means operatively connected to said resistance means and said pivot axis for transmitting said resistance force to said pedal.

45. The exercise apparatus of claim 44 wherein said resistance means includes an alternator.

46. The exercise apparatus of claim 40 wherein said guide member includes a first longitudinal track secured to said frame and configured to support said slider means.

47. The exercise apparatus of claim 46 wherein said slider means includes a first roller rotatably coupled to said pedal lever and resting on said first longitudinal track.

48. The exercise apparatus of claim 47 wherein said guide member further includes a second longitudinal track aligned with said first longitudinal track and positioned above said first longitudinal track, said first and second longitudinal tracks being configured to engage said first roller.

49. The exercise apparatus of claim 48 wherein said first longitudinal track has a substantially arcuate cross section.

50. The exercise apparatus of claim 49 wherein said first roller is concave.

51. The exercise apparatus of claim 48 wherein said slider means further includes a second roller aligned with said first roller and engaged by said first and second tracks.

52. The exercise apparatus of claim 51 further including an arm and coupling means for coupling said arm to said pedal lever such that said arm moves toward said second end of said pedal lever when said second end of said pedal lever moves in said reciprocating pathway in a direction towards said pivot axis.

53. The exercise apparatus of claim 51 wherein said first longitudinal track has a substantially arcuate cross section.

54. The exercise apparatus of claim 53 wherein said first roller is concave.

55. The exercise apparatus of claim 53 wherein said second roller is convex.

56. The exercise apparatus of claim 48 wherein said frame further includes a vertical support member positioned intermediate said pivot axis and said second end of said pedal lever.

57. The exercise apparatus of claim 56 further including a handrail rigidly secured to said vertical support member.

58. The exercise apparatus of claim 56 further including a first arm link pivotally coupled with said pedal lever proximate to said second end and extending toward said pivot axis, a second arm link pivotally coupled to said first arm link and extending from said first arm link toward said vertical support member, an arm, and a shaft rigidly secured to said second arm link, rotatably supported by said vertical support member, and rigidly secured to said arm, said arm moving toward said second end of said pedal lever when said second end of said pedal lever moves in said reciprocating pathway in a direction towards said pivot axis.

59. The exercise apparatus of claim 58 further including a handgrip secured to said arm and extending from said arm at a predetermined angle.

60. The exercise apparatus of claim 58 further including a handrail rigidly secured to said vertical support member.

61. The exercise apparatus of claim 47 wherein said slider means further includes a second roller rotatably coupled to said pedal lever substantially opposite said first roller and wherein said guide member further includes a second longitudinal track laterally spaced apart from said first longitudinal track and configured to engage said second roller.

62. The exercise apparatus of claim 61 wherein said guide member further includes third and fourth tracks, said third track being aligned with said first longitudinal track and positioned above said first longitudinal track, said fourth track being aligned with and positioned above said second longitudinal track.

63. The exercise apparatus of claim 62 wherein said slider means further includes third and fourth rollers, said third roller being engaged by said first and third tracks and said fourth roller being engaged by said second and fourth tracks.

64. The exercise apparatus of claim 63 further including an arm and coupling means for coupling said arm to said pedal lever such that said arm moves toward said second end of said pedal lever when said second end of said pedal lever moves in said reciprocating pathway in a direction towards said pivot axis.

65. The exercise apparatus of claim 63 wherein each of said first and second tracks has a substantially arcuate cross section.

66. The exercise apparatus of claim 65 wherein said first and second rollers are concave.

67. The exercise apparatus of claim 61 wherein said frame further includes a vertical support member positioned intermediate said pivot axis and said second end of said pedal lever.

68. The exercise apparatus of claim 67 further including a handrail rigidly secured to said vertical support member.

69. The exercise apparatus of claim 67 further including a first arm link pivotally located between said first and third tracks, coupled with said pedal lever proximate to said second end, and extending toward said pivot axis, a second arm link pivotally coupled to said first arm link and extending from said first arm link toward said vertical support member, an arm, and a shaft rigidly secured to said second arm link, rotatably supported by said vertical support member, and rigidly secured to said arm, said arm moving toward said second end of said pedal lever when said second end of said pedal lever moves in said reciprocating pathway in a direction towards said pivot axis.

70. The exercise apparatus of claim 69 further including a handgrip secured to said arm and extending from said arm at a predetermined angle.

71. The exercise apparatus of claim 69 further including a handrail rigidly secured to said vertical support member.

72. The exercise apparatus of claim 42 further including a first cross member and a second cross member and wherein said guide member includes a first longitudinal track secured to said first and second cross members and configured to support said second end of said pedal lever.

73. The exercise apparatus of claim 72 wherein said slider means includes a first roller rotatably coupled with said pedal lever and resting on said first longitudinal track.

74. The exercise apparatus of claim 73 wherein said guide member further includes a second longitudinal track and wherein said slider means further includes a second roller, said second longitudinal track being positioned above said first longitudinal track, said second roller being rotatably coupled with said pedal lever and resting on said second longitudinal track.

75. The exercise apparatus of claim 74 further including an arm and coupling means for coupling said arm to said pedal lever such that said arm moves toward said second end of said pedal lever when said second end of said pedal lever moves in said reciprocating pathway in a direction towards said pivot axis.

76. The exercise apparatus of claim 74 wherein said second longitudinal track has a substantially arcuate cross section and wherein said second roller is concave.

77. The exercise apparatus of claim 76 wherein said guide member further includes a third longitudinal track and wherein said slider means further includes a third roller, said third longitudinal track being positioned above said first longitudinal track and having a substantially arcuate cross section, said third roller being concave, laterally spaced apart from said second roller, rotatably coupled with said pedal lever, and resting on said third longitudinal track.

78. The exercise apparatus of claim 77 wherein said slider means further includes a fourth roller being rotatably coupled with said pedal lever, laterally spaced apart from said first roller, and resting on said first longitudinal track.

79. The exercise apparatus of claim 78 further including an arm and coupling means for coupling said arm to said pedal lever such that said arm moves toward said second end of said pedal lever when said second end of said pedal lever moves in said reciprocating pathway in a direction towards said pivot axis.

80. The exercise apparatus of claim 40 wherein said predetermined length of said first link and said predetermined length of said second link are unequal.

81. The exercise apparatus of claim 80 wherein said guide member includes a first longitudinal track secured to said frame and configured to support said slider means.

82. The exercise apparatus of claim 81 wherein said slider means includes a first roller rotatably coupled to said pedal lever and resting on said first longitudinal track.

83. The exercise apparatus of claim 82 wherein said guide member further includes a second longitudinal track aligned with said first longitudinal track and positioned above said first longitudinal track, said first and second longitudinal tracks being configured to engage said first roller.

84. The exercise apparatus of claim 83 wherein said first longitudinal track has a substantially arcuate cross section.

85. The exercise apparatus of claim 84 wherein said first roller is concave.

86. The exercise apparatus of claim 83 wherein said slider means further includes a second roller aligned with said first roller and engaged by said first and second tracks.

87. The exercise apparatus of claim 86 wherein said first longitudinal track has a substantially arcuate cross section.

88. The exercise apparatus of claim 87 wherein said first roller is concave.

89. The exercise apparatus of claim 87 wherein said second roller is convex.

90. The exercise apparatus of claim 83 wherein said frame further includes a vertical support member positioned intermediate said pivot axis and said second end of said pedal lever.

91. The exercise apparatus of claim 93 further including a handrail rigidly secured to said vertical support member.

92. The exercise apparatus of claim 90 further including a first arm link pivotally coupled with said pedal lever proximate to said second end and extending toward said pivot axis, a second arm link pivotally coupled to said first arm link and extending from said first arm link toward said vertical support member, an arm, and a shaft rigidly secured to said second arm link, rotatably supported by said vertical support member, and rigidly secured to said arm, said arm moving toward said second end of said pedal lever when said second end of said pedal lever moves in said reciprocating pathway in a direction towards said pivot axis.

93. The exercise apparatus of claim 92 further including a handgrip secured to said arm and extending from said arm at a predetermined angle.

94. The exercise apparatus of claim 92 further including a handrail rigidly secured to said vertical support member.

95. The exercise apparatus of claim 82 wherein said slider means further includes a second roller rotatably coupled to said pedal lever substantially opposite said first roller and wherein said guide member further includes a second longitudinal track laterally spaced apart from said first longitudinal track and configured to engage said second roller.

96. The exercise apparatus of claim 95 wherein said guide member further includes third and fourth tracks, said third track being aligned with said first longitudinal track and positioned above said first longitudinal track, said fourth track being aligned with and positioned above said second longitudinal track.

97. The exercise apparatus of claim 96 wherein said slider means further includes third and fourth rollers, said third roller being engaged by said first and third tracks and said fourth roller being engaged by said second and fourth tracks.

98. The exercise apparatus of claim 97 further including an arm and coupling means for coupling said arm to said pedal lever such that said arm moves toward said second end of said pedal lever when said second end of said pedal lever moves in said reciprocating pathway in a direction towards said pivot axis.

99. The exercise apparatus of claim 97 wherein each of said first and second tracks has a substantially arcuate cross section.

100. The exercise apparatus of claim 99 wherein said first and second rollers are concave.

101. The exercise apparatus of claim 95 wherein said frame further includes a vertical support member positioned intermediate said pivot axis and said second end of said pedal lever.

102. The exercise apparatus of claim 101 further including a handrail rigidly secured to said vertical support member.

103. The exercise apparatus of claim 101 further including a first arm link pivotally located between said first and third tracks, coupled with said pedal lever proximate to said second end, and extending toward said pivot axis, a second arm link pivotally coupled to said first arm link and extending from said first arm link toward said vertical support member, an arm, and a shaft rigidly secured to said second arm link, rotatably supported by said vertical support member, and rigidly secured to said arm, said arm moving toward said second end of said pedal lever when said second end of said pedal lever moves in said reciprocating pathway in a direction towards said pivot axis.

104. The exercise apparatus of claim 103 further including a handgrip secured to said arm and extending from said arm at a predetermined angle.

105. The exercise apparatus of claim 103 further including a handrail rigidly secured to said vertical support member.

106. The exercise apparatus of claim 80 further including a first cross member and a second cross member and wherein said guide member includes a first longitudinal track secured to said first and second cross members and configured to support said second end of said pedal lever.

107. The exercise apparatus of claim 106 wherein said slider means includes a first roller rotatably coupled with said pedal lever and resting on said first longitudinal track.

108. The exercise apparatus of claim 107 wherein said guide member further includes a second longitudinal track and wherein said slider means further includes a second roller, said second longitudinal track being positioned above said first longitudinal track, said second roller being rotatably coupled with said pedal lever and resting on said second longitudinal track.

109. The exercise apparatus of claim 108 further including an arm and coupling means for coupling said arm to said pedal lever such that said arm moves toward said second end of said pedal lever when said second end of said pedal lever moves in said reciprocating pathway in a direction towards said pivot axis.

110. The exercise apparatus of claim 108 wherein said second longitudinal track has a substantially arcuate cross section and wherein said second roller is concave.

111. The exercise apparatus of claim 110 wherein said guide member further includes a third longitudinal track and wherein said slider means further includes a third roller, said third longitudinal track being positioned above said first longitudinal track and having a substantially arcuate cross section, said third roller being concave, laterally spaced apart from said second roller, rotatably coupled with said pedal lever, and resting on said third longitudinal track.

112. The exercise apparatus of claim 111 wherein said slider means further includes a fourth roller being rotatably coupled with said pedal lever, laterally spaced apart from said first roller, and resting on said first longitudinal track.

113. The exercise apparatus of claim 112 further including an arm and coupling means for coupling said arm to said pedal lever such that said arm moves toward said second end of said pedal lever when said second end of said pedal lever moves in said reciprocating pathway in a direction towards said pivot axis.

114. An exercise apparatus comprising:

a frame;

a pedal supported by said frame and configured to be moved by a user in a generally rotational motion in a first direction and in a second opposite rotational direction;

resistance means for applying a resistive force to said pedal;

control means for controlling said resistance means;

first display means for indicating to the user to cease moving said pedal in said first direction; and second distinct display means for indicating to the user to resume moving said pedal in said second opposite direction.

115. The apparatus of claim 114 wherein said rotational motion is generally elliptical in shape.

116. The apparatus of claim 115 wherein said control means includes braking means for causing said resistance means to apply a braking force to said pedal after said first display means displays said indication to the user to cease moving said pedal in said first direction.

117. An exercise apparatus comprising:

a frame;

a pedal supported by said frame and configured to be moved by a user in a generally elliptical motion;

resistance means for applying a resistive force to said pedal;

motion detecting means for detecting an initial movement of said pedal by the user; and control means for controlling said resistance means so that said resistance means automatically applies an initial high resistance force approximately equal to the maximum resistance force that can be generated by said resistance means to said pedal in response to said initial motion.

118. The apparatus of claim 117 wherein said control means causes said resistance means to apply a minimum resistance to said pedal when said pedal is not rotating.

119. The apparatus of claim 118 wherein said resistance means includes an alternator controlled by a field current and wherein said minimum resistance is generated by said control means applying said field current to said alternator of approximately 3 to 6 percent of the maximum field current for said alternator.

120. The apparatus of claim 119 wherein said control means is effective to apply said maximum field current to said alternator when said initial motion is detected by said motion detecting means.

* * * * *